US006701674B1

(12) United States Patent
Albracht

(10) Patent No.: US 6,701,674 B1
(45) Date of Patent: Mar. 9, 2004

(54) SNAP-ON INSTALLATION GUTTER PROTECTION SYSTEM, WITH MOUNTING BRACKET, AND METHOD OF USE

(76) Inventor: Gregory P. Albracht, 9623 Burdette St., Omaha, NE (US) 68134

( * ) Notice: Subject to any disclaimer, the term of this patent is extended or adjusted under 35 U.S.C. 154(b) by 0 days.

(21) Appl. No.: 09/492,449

(22) Filed: Jan. 27, 2000

Related U.S. Application Data

(60) Provisional application No. 60/117,422, filed on Jan. 27, 1999.

(51) Int. Cl.[7] ..... E04D 13/064
(52) U.S. Cl. ..... 52/12; 52/11; 52/15
(58) Field of Search ..... 52/11, 12, 15, 52/24

(56) References Cited

U.S. PATENT DOCUMENTS

| | | | | | |
|---|---|---|---|---|---|
| 4,876,827 | A | * | 10/1989 | Williams | 52/12 |
| 5,044,581 | A | * | 9/1991 | Dressler | 248/48.1 |
| 5,557,891 | A | | 9/1996 | Albracht | |
| 5,570,860 | A | | 11/1996 | Schoenherr | |
| 5,617,678 | A | * | 4/1997 | Morandin et al. | 52/11 |
| 5,619,825 | A | * | 4/1997 | Leroney et al. | 52/12 |
| 5,640,809 | A | * | 6/1997 | Iannelli | 52/12 |
| 5,660,001 | A | | 8/1997 | Albracht | |
| 5,718,085 | A | | 2/1998 | Plum | |
| 5,737,879 | A | | 4/1998 | Sweet | |
| 5,862,631 | A | * | 1/1999 | Attaway et al. | 52/11 |
| 6,098,344 | A | * | 8/2000 | Albracht | 52/12 |

FOREIGN PATENT DOCUMENTS

| | | |
|---|---|---|
| WO | WO 98/04793 | 2/1998 |

* cited by examiner

*Primary Examiner*—Carl D. Friedman
*Assistant Examiner*—Yvonne M. Horton
(74) *Attorney, Agent, or Firm*—Rothwell, Figg, Ernst & Manbeck

(57) ABSTRACT

A gutter protection system and method of installation is provided. In a first aspect, the gutter protection system includes a gutter cover having an upper portion and a lower portion, with the lower portion having a nose portion including a return portion that is bent downward and backward substantially toward a center region of the gutter to guide a water stream into the gutter, and a bracket for holding the gutter cover, with the bracket having a lower portion engaging the gutter and an upper portion extending above the gutter and engaging the lower portion of the gutter cover, wherein the bracket holds the gutter cover in position in relation to the gutter so that the upper portion of the gutter cover is positioned over a roof and the lower portion is positioned over the gutter at a predetermined angle.

81 Claims, 14 Drawing Sheets

SNAP-ON INSTALLATION GUTTER PROTECTION SYSTEM, WITH MOUNTING BRACKET, AND METHOD OF USE

CROSS-REFERENCE TO RELATED APPLICATION

The present application claims priority from, and the benefit of the filing date of, U.S. Provisional Patent Application Serial No. 60/117,422, filed Jan. 27, 1999.

BACKGROUND OF THE INVENTION

1. Field of the Invention

The present invention relates generally to a gutter protection system.

2. Description of the Background Art

As disclosed in U.S. Pat. Nos. 5,557,891, & 5,660,001 to Albracht, numerous gutter protection systems, and methods of their use, have been devised which, when mounted to gutters at lower edges of sloped building roofs, to greater or lesser degrees prevent debris from entering thereinto, while allowing the entry of rain water. However, all such prior systems, including those in the previous Albracht '891 and '001 patents, suffer from at least some complication regarding installation in that mounting screws, or interfacing clips etc. are required. A need remains for a gutter protection system which is snap-on easy to install. The present invention provides such a system, and method of its use.

SUMMARY OF THE INVENTION

A gutter protection system is provided according to a first aspect of the invention. The gutter protection system comprises a gutter cover having a length and having an upper portion positioned over a roof and a lower portion for being positioned over the gutter, with the lower portion having a nose portion, the nose portion including a return portion that is bent downward and backward substantially toward a center region of the gutter to guide a water stream into the gutter, and at least one projection positioned between the lower and upper portions, and a bracket for holding the gutter cover in relation to the gutter, the bracket having a lower portion engaging the gutter and an upper portion extending above the gutter and engaging the lower portion of the gutter cover, the lower portion of the bracket having a rear leg having a substantially vertical portion adapted to be positioned against the rear wall of the gutter and a front leg positioned within the front lip of the gutter, the upper portion of the bracket having a nose piece fitting inside the nose portion of the gutter cover, and the bracket having a cover retaining lip on a rear region of the upper portion, the cover retaining lip engages the at least one projection of the gutter cover, wherein the bracket holds the gutter cover in position in relation to the gutter so that the upper portion of the gutter cover is positioned over a roof and the lower portion of the gutter cover is positioned over the gutter at a predetermined angle, and wherein the at least one projection of the gutter cover engages the cover retaining lip of the bracket while the nose portion of the gutter cover fits over the nose piece of the bracket so that the gutter cover is held at two points on the bracket.

A gutter protection system is provided according to a second aspect of the invention. The gutter protection system comprises a gutter having a length, front and rear walls, a gutter front lip extending backward from the front wall into the gutter, and a bottom surface, with the rear wall including a rear wall top lip and the front wall including a front wall top lip, a gutter cover having a length and having an upper portion positioned over a roof and a lower portion for being positioned over the gutter, with the lower portion having a nose portion, the nose portion including a return portion that is bent downward and backward substantially toward a center region of the gutter to guide a water stream into the gutter, and at least one projection positioned between the lower and upper portions, and a bracket for holding the gutter cover in relation to the gutter, the bracket having a lower portion engaging the gutter and an upper portion extending above the gutter and engaging the lower portion of the gutter cover, the lower portion of the bracket having a rear leg having a substantially vertical portion adapted to be positioned against the rear wall of the gutter and including a clip having a throat leading to a wider portion, the lower portion further having a front leg positioned within the front lip of the gutter, the upper portion of the bracket having a nose piece fitting inside the nose portion of the gutter cover, and the bracket having a cover retaining lip on a rear region of the upper portion, the cover retaining lip engages the at least one projection of the gutter cover, wherein the bracket holds the gutter cover in position in relation to the gutter so that the upper portion of the gutter cover is positioned over a roof and the lower portion of the gutter cover is positioned over the gutter at a predetermined angle, and wherein the at least one projection of the gutter cover engages the cover retaining lip of the bracket while the nose portion of the gutter cover fits over the nose piece of the bracket so that the gutter cover is held at two points on the bracket.

A gutter protection system is provided according to a third aspect of the invention. The gutter protection system comprises, as viewed in left side elevation, when mounted to a sloped roof building and beginning at the left side thereof, a first downward and to the right projecting length of construction material (2), which first downward and to the right projecting length of construction material (2) merges into a lip, the lip providing a length of construction material which projects downward and to the left, the lip, at the position of its merging from the first downward and to the right projecting length of construction material (2) being functionally merged into a length of construction material (4) which projects downward and to the right at a nominal fifteen (15%) percent grade, the length of construction material (4) which projects downward and to the right at a nominal fifteen (15%) grade being merged into a into a following downward and to the left projecting length of construction material (6), which merges into a short upward length of construction material (7).

A gutter protection system is provided according to a fourth aspect of the invention. The gutter protection system comprises, as viewed in left side elevation, when mounted to a sloped roof building and beginning at the left side thereof, an upward and to the right projecting length of construction material (1) at the left side thereof, which is merged into the first downward and to the right projecting length of construction material (2), the first downward and to the right projecting length of construction material (2) bing merged into a lip, the lip providing a length of construction material which projects downward and to the left, the lip at the position of its merging from the first downward and to the right projecting length of construction material (2) being functionally merged into a length of construction material (4) which projects downward and to the right at a nominal fifteen (15%) percent grade, the length of construction material (4) which projects downward and to the right at a nominal fifteen (15%) percent grade being merged into a into a following downward and to the left projecting length of construction material (6), which merges into a short upward projecting length of construction material (7);

wherein the lip is formed by merging from the first downward and to the right projecting length of construction material (2) into a downward and to the left projecting length of construction material which is merging into an upward and to the right projecting length of construction material which merges into the length of construction material (4) which projects downward and to the right at a nominal fifteen (15%) percent grade;

wherein the length of construction material (4) which projects downward and to the right at a nominal fifteen (15%) percent grade is merged into the following downward and to the left projecting length of construction material (6) by an intervening length of construction material (5) which is of a shape selected from the group consisting of: (at least one curved length of construction material, at least one straight length of construction material and a combination of at least one curved length of construction material and at least one straight length of construction material);

wherein, in use, the gutter protection system is mounted to an underlying gutter system, which as viewed in left side elevation, comprises a vertical back at the left side, which an essentially vertical back is affixed to a wall of a building which has a sloped roof, the gutter system further comprising an essentially horizontal bottom which merges from the essentially vertical back via a bottom ninety (90) degree bend, and the essentially horizontal bottom projecting to where, at a right side of the essentially horizontal bottom, one or more lengths of gutter material of shapes selected from the group consisting of: (straight and curved), project to a point where an upper right side ninety (90) degree bend is horizontally offset from the essentially vertical back and vertical offset from the essentially horizontal bottom;

the gutter protection system being mounted to the gutter system by way of at least one mounting bracket, the at least one mounting bracket being comprised of at least two "snap-points", which "snap-points" mate with the lip and short upward projecting length of construction material (7) respectively in use, and force the length of construction material (4) to project downward and to the right at a nominal fifteen (15%) percent grade;

the mounting bracket, in use, being secured by contact with both the bottom ninety (90) degree bend and the upper right side ninety (90) degree bend of the gutter system, such that a gap between the following downward and to the left projecting length of construction material (6) of the gutter projection system, and the nearest aspect of the upper right side ninety (90) degree bend of the gutter system is one-half (½) inch of less.

A gutter protection system is provided according to a fifth aspect of the invention. The gutter protection system comprises a gutter, a gutter cover, and a bracket secured to a fascia board of a building under a roof line, having a first means for supporting the gutter thereon, and a second means for supporting the gutter cover thereon in a location covering a top of the gutter and allowing water flow from the roof to be directed into the gutter.

A gutter protection system installation method of installing a bracket of the gutter protection system is provided according to a sixth aspect of the invention. The method comprises the steps of positioning a bracket in a gutter in a placement wherein the bracket is not substantially transverse to the gutter, and a lowermost portion of the bracket is in contact with a bottom surface of the gutter, and rotating the bracket until the bracket is substantially transverse to the gutter and a frontmost portion of the bracket is in contact with a front wall of the gutter.

A gutter protection system installation method of installing a bracket and a gutter cover of the gutter protection system is provided according to a seventh aspect of the invention. The method comprises the steps of positioning a bracket in a gutter in a placement wherein the bracket is not substantially transverse to the gutter, and a lowermost portion of the bracket is in contact with a bottom surface of the gutter, rotating the bracket until the bracket is substantially transverse to the gutter and a frontmost portion of the bracket is in contact with a front wall of the gutter, placing a nose portion of the gutter cover over a nose piece of the bracket, and inserting a projection of the gutter cover into a cover retaining lip of the bracket.

A gutter protection system installation method of installing a gutter and a bracket of the gutter protection system is provided according to an eighth aspect of the invention. The method comprises the steps of affixing a rear leg of the bracket to a roof structure, the rear leg including a clip, moving a rear wall of the gutter up into the clip of the bracket, the rear wall including a rear wall top lip that snaps into and is removably retained by the clip, and moving a front wall of the gutter up and over a front leg of the bracket, the front wall including a front wall top lip that snaps over and is removably retained by the front leg.

A gutter protection system installation method of installing a gutter protection system is provided according to a ninth aspect of the invention. The method comprises the steps of a. providing a building or the like which has a sloped roof which has a gutter system affixed thereto at a lower edge of the sloped roof;

b. providing a gutter protection system comprising, as viewed in left side elevation, when mounted to a sloped roof building and beginning at the left side thereof:

an upward and to the right projecting length of construction material (1) at the left side thereof, which is merged into a first downward and to the right projecting length of construction material (2), the first downward and to the right projecting length of construction material (2) being merged into a lip, the lip providing a length of construction material which projects downward and to the left, the lip, at the position of its merging from the first downward and to the right projecting length of construction material (2) being functionally merged into a length of construction material (4) which projects downward and to the right at a nominal fifteen (15%) percent grade, the length of construction material(4) which projects downward and to the right at a nominal fifteen (15%) percent grade being merged into a into a following downward and to the left projecting length of construction material (6), which merges into a short upward projecting length of construction material (7);

wherein the lip is formed by merging from the first downward and to the right projecting length of construction material (2) into a downward and to the left projecting length of construction material which is merging into an upward and to the right projecting length of construction material which merges into the length of construction material (4) which projects downward and to the right at a nominal fifteen (15%) percent grade;

wherein the length of construction material (4) which projects downward and to the right at a nominal fifteen (15%) percent grade is merged into the following downward and to the left projecting length of construction material (6), by an intervening length of construction material (50 which is of a shape selected from the group consisting of: (at least one curved length of construction material, at least one straight length of construction material and a combination of at least one curved length of construction material and at least one straight length of construction material);

wherein, in use, the gutter protection system is mounted to the underlying gutter system, which as viewed in left side elevation, comprises a vertical back at the left side, which an essentially vertical back is affixed to a wall of a building which has a sloped roof, the gutter system further comprising an essentially horizontal bottom which merges from the essentially vertical back via a bottom ninety (90) degree bend, and the essentially horizontal bottom projecting to where, at a right side of the essentially horizontal bottom, one or more lengths of gutter material of shapes selected from the group consisting of:

(straight and curved), project to a point where an upper right side ninety (90) degree bend is formed, which upper right side ninety (90) degree bend is horizontally offset from the essentially vertical back and vertical offset from the essentially horizontal bottom;

the gutter protection system, in use, being mounted to the gutter system by way of at least one mounting bracket, the at least one mounting bracket being comprised of at least two "snap-points", which "snap-points" mate with the lip and short upward projecting length of construction material (7)*n* respectively in use, and force the length of construction material (4) to project downward and to the right at a nominal fifteen (15%) percent grade;

the mounting bracket, in use, being secured by contact with both the bottom ninety (90) degree bend and the upper right side ninety (90) degree bend of the gutter system, such that a gap between the following downward and to the left projecting length of construction material (6) of the gutter protection system, and the nearest aspect of the upper right side ninety (90) degree bend of the gutter system is one-half (½) inch or less;

c. Placing the at least one mounting bracket into the gutter system and using a rotational motion, about a vertically oriented axis, securing the mounting bracket in place in the gutter system such that it is snugly held in place by contact with both the bottom ninety (90) degree bend and the upper right side ninety (90) degree bend of the gutter system;

d. Positioning a gutter protection system atop the at least one mounting bracket, and using a pushing motion causing the lip thereof to mate with the "snap-point" of the mounting bracket, and the short upward projecting "snap-point" of the mounting bracket;

such that the left side of the gutter protection system contacts the roof of the sloped roof building by a selection from the group consisting of: (atop shingles and under shingles); and such that a gap between the following downward and to the left projecting length of construction material (6) of the gutter protection system, and the nearest aspect of the upper right side ninety (90) degree bend of the gutter system is one-half (½) inch or less.

The above and other features and advantages of the present invention will be further understood from the following description of the preferred embodiments thereof, taken in conjunction with the accompanying drawings.

DETAILED DESCRIPTION OF THE PREFERRED EMBODIMENTS

Figure 1:
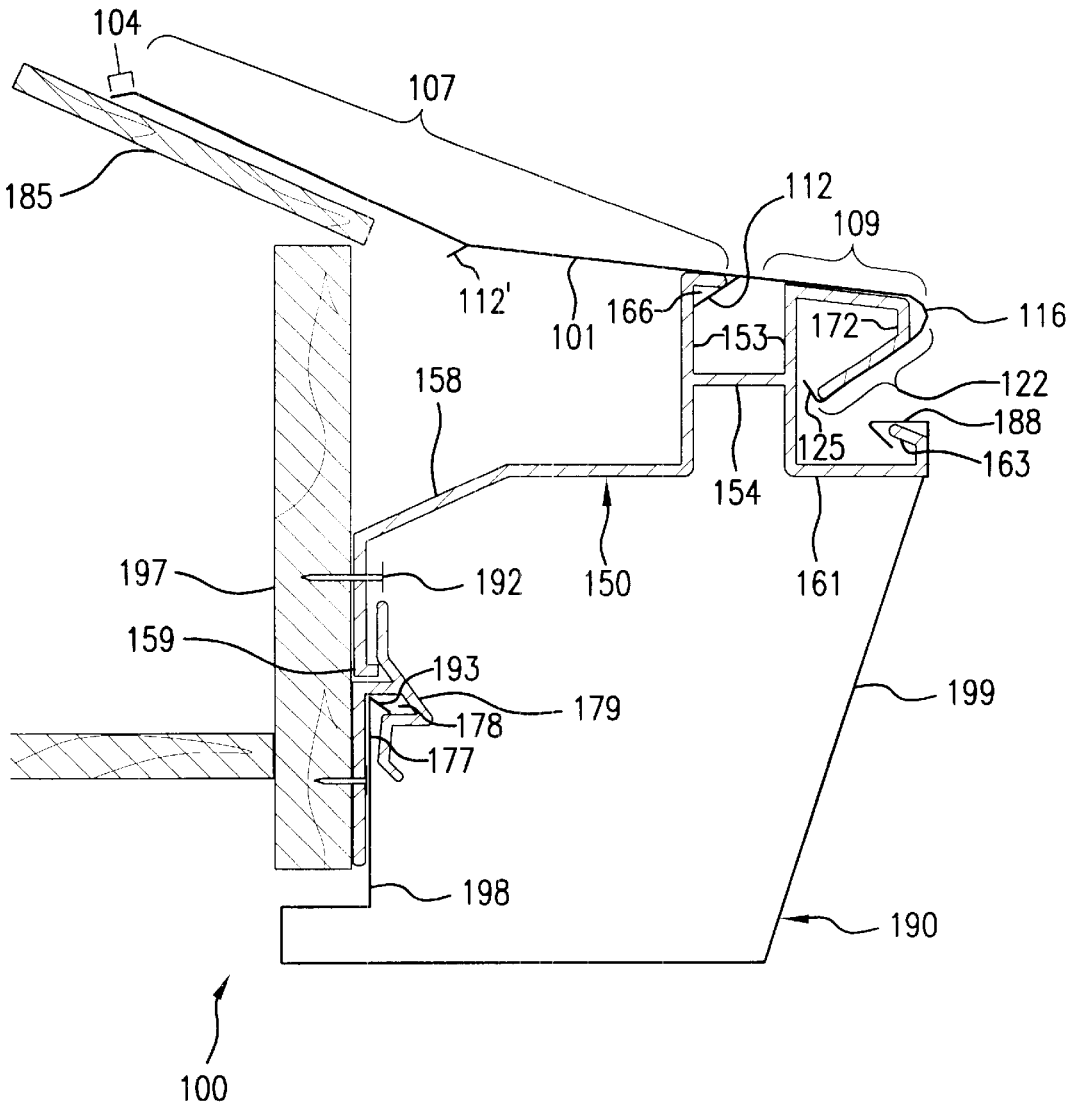
FIG. 1 shows a first embodiment of the gutter protection system of the present invention.

FIG. 1 shows a first embodiment 100 of the gutter protection system of the present invention. The gutter protection system 100 may be mounted to roof structure 185, preferably on a fascia board 197. The gutter protection system 100 includes a gutter 190, a cover 101, and a bracket 150.

The cover 101, bracket 150, and gutter 190 may be formed of a variety of materials, such as, for example, metal, plastic, fiberglass, or vinyl.

The cover 101 is formed of a sheet material and includes a roof seating lip 104, an upper portion 107, a lower portion 109, at least one projection or flex fold 112, a nose portion 116, a return portion 122, and a bracket retention lip 125. The cover 101 may be formed according to various embodiments, as discussed below in conjunction with FIGS. 1–2 and 7–12. The embodiment 101 shown in FIG. 1 is an exemplary embodiment, and illustrates the basic features of the cover 101.

The upper portion 107 extends over a roof 185, with the upper portion 107 generally extending over the roof 185 a distance approximately equal to the width of the associated gutter 190. Therefore, in general terms, for a five inch wide gutter 190, for example, the upper portion 107 will extend about 4 to about 6 inches up on the roof 185. For a seven inch wide gutter, the upper portion will extend about 6 to about 8 inches up. However, it should be understood that although generally this is true, in cases where the gutter is mounted on the roof in a very low position the upper portion 107 may extend up onto the roof only a small distance.

Figure 16B:
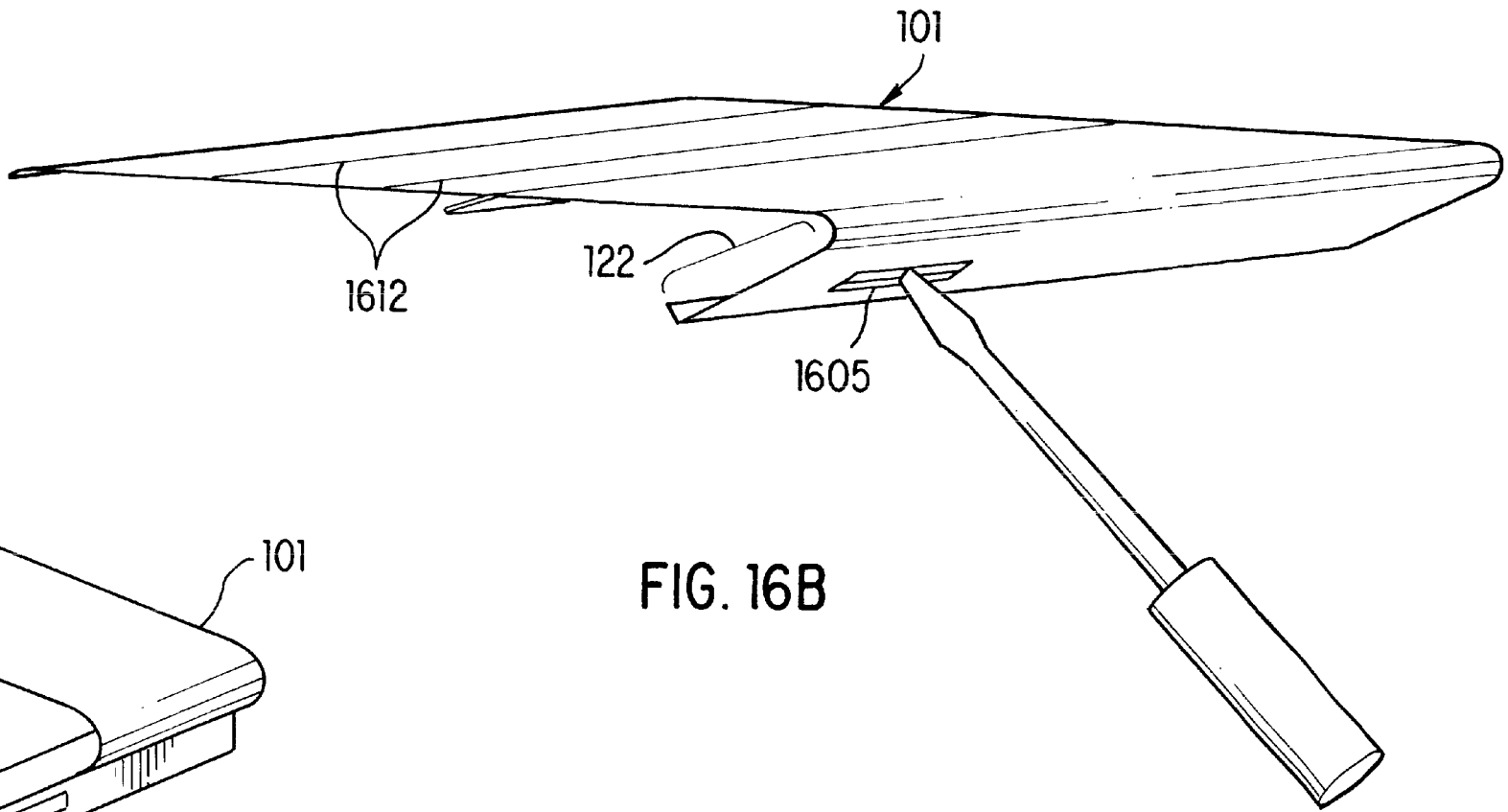
FIGS. 16A–16B show a slot that may be used during assembly or removal of the cover.

The cover 101 may optionally include one or more scoring lines 1612 (see FIG. 16). The scoring lines 1612 are preferably on the underside of the cover 101, but may also be placed on the top side. The scoring lines 1612 minimally weaken the cover 101 and allow the cover 101 to be broken to size to accommodate different roof sizes or types. It should be understood that although the scoring lines are mentioned with regard to the embodiment of FIG. 16, the scoring lines may be formed on all of the various embodiments of the cover 101.

The upper portion 107 includes a roof seating lip 104, with the roof seating lip 104 resting on the shingles or other roof materials (not shown). The roof seating lip 104 may be positioned securely on the roof, exerting an amount of downward pressure so that water and debris travel over the top of the cover 101. In a lesser preferred embodiment, the roof seating lip 104 may be positioned underneath a row of shingles, depending on the shingle size and the size of the upper portion 107 (see FIG. 11A).

The lower portion 109 is positioned over the gutter 190, with the projection 112 being formed between the upper portion 107 and the lower portion 109. Generally, when the cover 101 is in position, the lower portion 109 will form an angle of about three degrees to about twenty degrees from the horizontal, and preferably fifteen degrees.

Multiple projections 112, 112', etc., may be formed on the cover 101. The projection or flex fold 112 allows the cover 101 to flex in order to accommodate roofs of varying pitch. The projection 112 is preferably located within sixty-five percent of the distance from the nose portion 116 to the rear wall 198 of the gutter 190. The projection 112 is also part of the retaining features of the cover 101, and will be discussed below. Various shapes of projections 112 may be formed in the cover 101, as discussed below in conjunction with FIGS. 8A–8E.

The nose portion 116 in this embodiment is rounded so that the lower portion 109 forms the return portion 122. In the preferred embodiment, the nose portion 116 is even with or is set back from the front of the gutter 190, but could alternatively extend beyond the front of the gutter 190. In the preferred embodiment, the return portion 122 forms an angle of about 33 degrees down from the horizontal, although the angle may range from about 20 to about 60 degrees. In addition, the end of the return portion 122 is bent up to a substantially vertical orientation to form the bracket retention lip 125.

The cover 101 may be treated to make the material of the cover 101 hydrophilic, that is, treated so that water tends to be attracted to the material. This may be done to create a "sheeting action" between the cover 101 and water flowing over the cover in order to improve the flow of water. Although many materials used in gutter systems become somewhat hydrophilic over time due to exposure to the sun, newly formed gutter systems generally are not hydrophilic. Therefore, to improve performance of a gutter cover or a gutter, they may be treated to form a hydrophilic layer.

The cover 101 (and the gutter 190) may be treated by exposing them to coffee and/or milk. In particular, the treatment of aluminum with coffee or milk causes the surface to become immediately hydrophilic.

The bracket 150 may include one or more upper legs 153, a leg bridge 154, a rear leg 158, a front leg 161, a front leg lip 163, a cover retaining lip 166, a nose piece 172, a clip 179, and a foot 159. In a preferred embodiment, the clip 179 is a separate piece to which the foot 159 may be inserted and removably retained, but alternatively, the clip 179 may be formed as part of the bracket 150. The clip 179 includes a throat 177 leading to a wider portion 178, with the wider portion 178 serving to trap and retain the rear wall top lip 193.

The upper legs 153 connect the rear leg 158, the front leg 161, the cover retaining lip 166, and the nose piece 172. The upper legs 153 in the preferred embodiment are two full upper legs 153 connected by the leg bridge 154. Alternatively any number of legs may be employed. The leg bridge 154 allows a predetermined amount of flex in the bracket 150.

The nose piece 172 forms a forward projecting section over which the nose portion 116 of the cover 101 fits. The front leg 161 extends forward and forms another contact and holding point between the bracket 150 and the gutter 190.

In use, the bracket 150 of the first embodiment 100 may be fastened to the fascia board 197 by fasteners such as nails or screws, for example. Then the rear wall 198 of the gutter 190 may be moved upward until the rear wall top lip 193 is engaged in the wider portion 178 of the clip 179 and is retained by the throat 177. At the same time, the front wall 199 may be moved upward until the front wall top lip 188 snaps over the front leg 161 of the bracket 150. In this manner, each bracket 150 holds the gutter 190 at two separate locations, and a plurality of brackets 150 may be used to removably install the gutter 190.

The cover 101 and, more specifically, the nose portion 116 may be snapped over the nose piece 172 while the projection 112 engages the cover retaining lip 166. Because the cover 101 is held in two separate locations, the bracket 150 securely and firmly holds the cover 101. The angle of the downward portion of the nose piece 172 may be set so that a small amount of tension is placed on the return portion 122 of the cover 101. When the cover 101 has been inserted onto the bracket 150 (or a plurality of brackets 150), the upper portion 107 and receding lip 104 extend up over and come into contact with a roof 185. Due to the projection 112, a certain amount of tension is placed onto the upper portion when inserted onto the roof 185. The tension may increase if the roof pitch is great. The cover 101 may be removed by pulling the projection 112 out of the cover retaining lip 166 (removal is further discussed in conjunction with FIG. 16).

Figure 2:
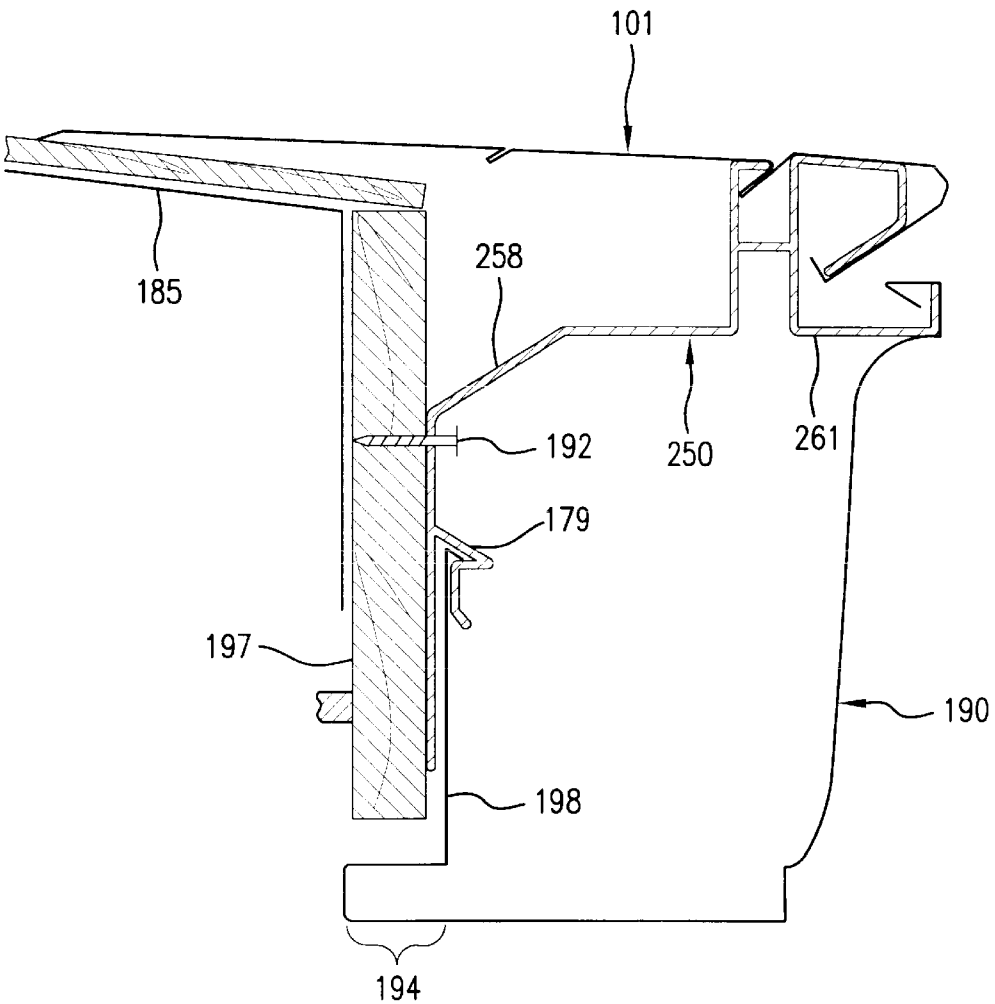
FIG. 2 shows a second embodiment of the bracket wherein the rear leg includes a clip formed thereon.

FIG. 2 shows a second embodiment of the bracket 250 wherein the rear leg 258 includes a clip 179 formed thereon. As in the first embodiment, the clip is adapted to removably retain the rear wall 198 of the gutter 190.

The rear leg 258 of the bracket 250 may include substantially horizontal scoring lines (not shown) on a lower portion of the rear leg 258. These scoring lines allow the bracket to be broken off, therefore accommodating different roof types, different roof sizes, or more particularly different sizes of fascia board 197. It should be understood that although the scoring lines are mentioned with regard to the embodiment of FIG. 2, the scoring lines may be formed on all of the various embodiments of the bracket 150.

Figure 3:
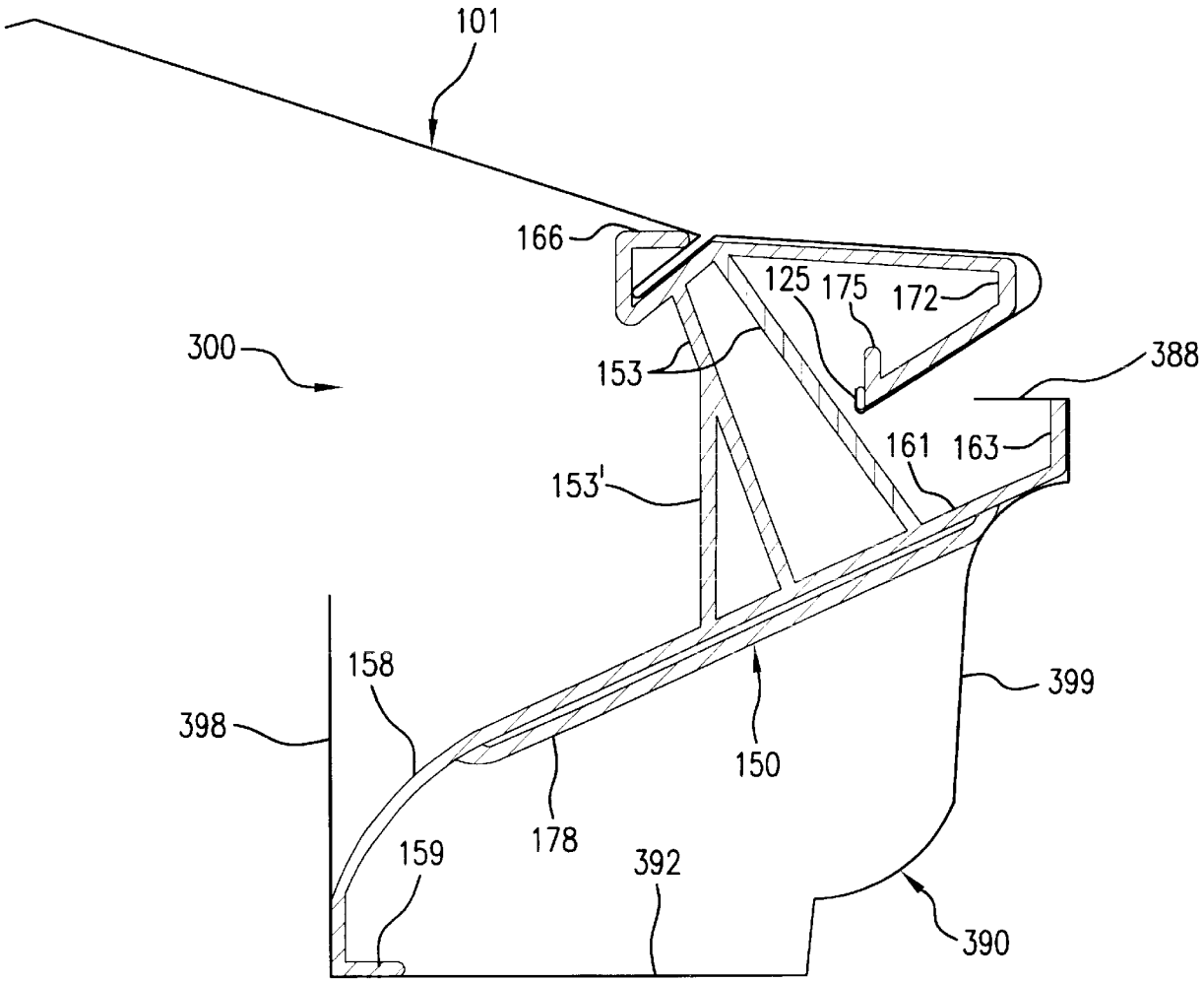
FIG. 3 shows a third embodiment designed for use with a conventional style gutter.

FIG. 3 shows a third embodiment 300 designed for use with a conventional style gutter. In this third embodiment, the rear leg 158 curves down and back to engage the bottom rear corner of the gutter 390. The curved portion may allow the bracket 150 to flex, and therefore accommodate variations in the size of the gutter 390 or accommodate variations in the gutter 390 due to its mounting. Two upright legs 153 and a leg brace 153' connect the rear leg 158, the front leg 161, the cover retaining lip 166, and the nose piece 172. The bracket 150 may optionally include a brace 178 extending at least partially between the rear leg 158 and the front leg 161, and a foot 159 formed on the rear leg 158. The nose piece lip 175 may be formed on the rear of the nose piece 172 and engages the bracket retention lip of the cover 101. The rear leg 158 extends down and back to the rear area of the gutter 390 and fits into the bottom of the gutter. The optional foot 159 provides additional support for the rear leg 158 and preferably contacts the bottom surface of the gutter 390. The bracket retention lip 125 snaps over the bottom rear portion of the nose piece 172 and preferably contacts the nose piece lip 175.

In use, the bracket 150 of the third embodiment 300 can be inserted into the gutter 390 by placing the bracket 150 down into the gutter 390 and twisting the bracket 150 until it is completely transverse to the gutter 390. This insert and twist action provides a snug fit while not requiring the use of fasteners. The embodiment of the bracket 150 shown is therefore designed to fit into a custom gutter as shown in the figure. However, the bracket 150 may also be formed to fit into and work with conventional gutter styles, configurations, and sizes.

Once the bracket 150 has been inserted into the gutter 390, the gutter cover 101 may be attached to individual brackets. A plurality of brackets 150 may be used in a section of gutter 390.

Figure 4A:
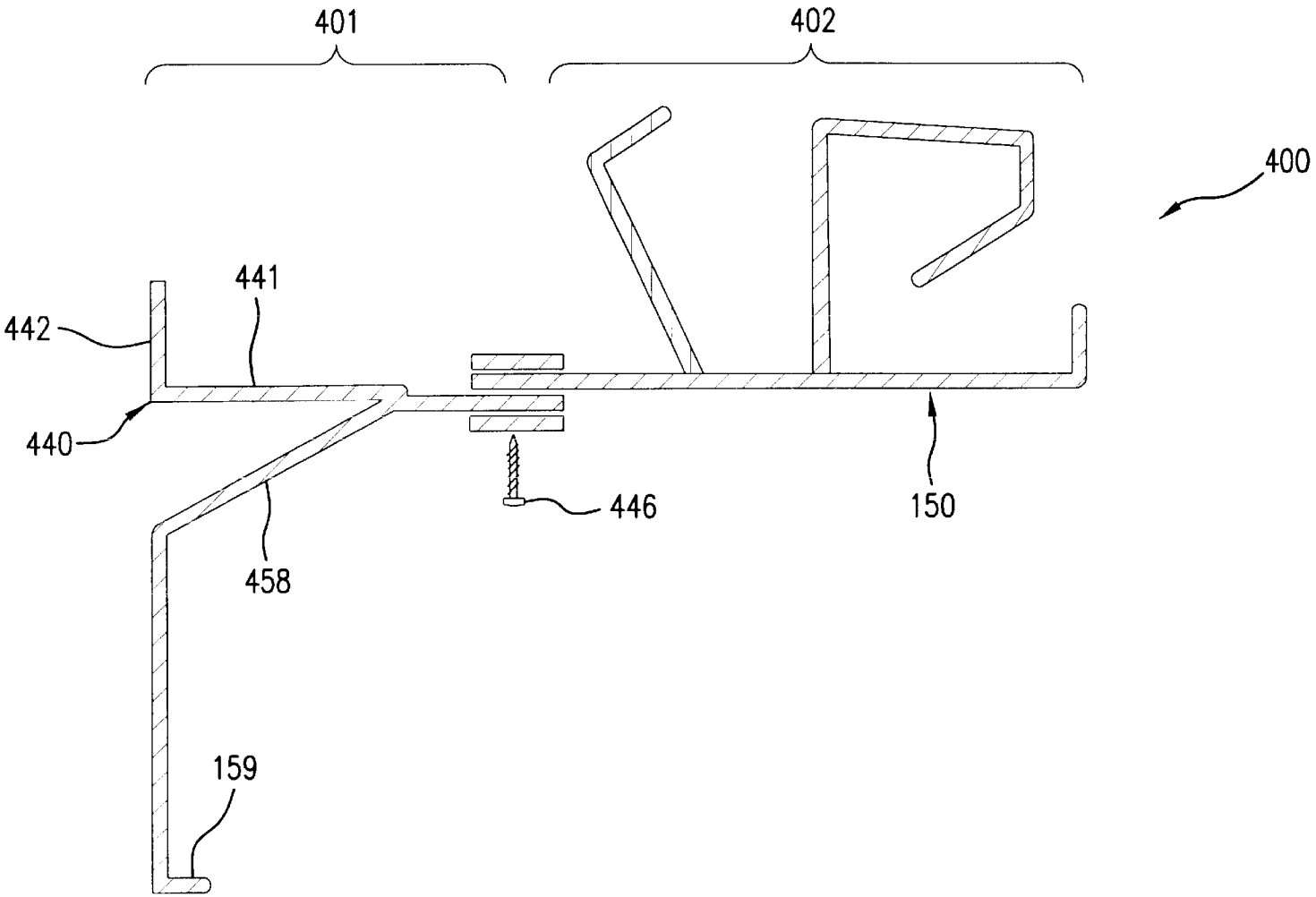
FIG. 4A shows a fourth embodiment having a rear portion and a front portion.

FIG. 4A shows a fourth embodiment 400 having a rear portion 401 and a front portion 402. In addition, the rear leg 458 has an additional leg portion 440 comprising a horizontal portion 441 and a vertical portion 442. The vertical portion 442 is adapted to contact the rear wall 198 of the gutter 190 (or the fascia board 197). Optionally, the vertical portion 442 may include holes for fasteners (not shown). The additional leg portion 440 may be part of the rear leg 458 or may be a separate piece. If separate, the rear portion 401 may be joined to the front portion 402 by means of a clamp (as shown) or through a fastener such as a bolt or a screw. Alternatively, the connection may be done through springs, spring clips, detents, notches, pins, etc.

Figure 4B:
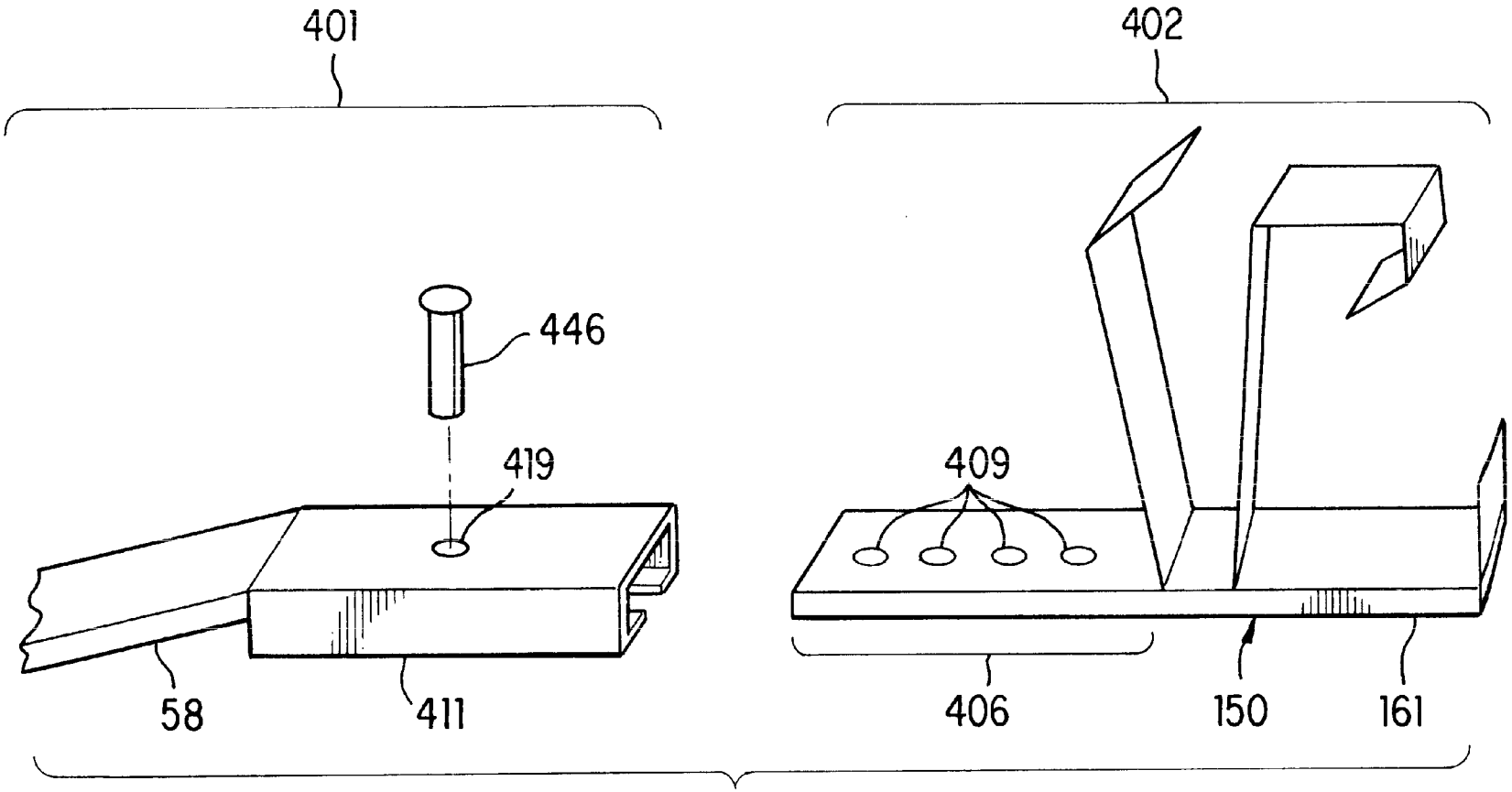
FIG. 4B shows an alternate embodiment for joining the front portion to the rear portion.

FIG. 4B shows an alternate embodiment for joining the front portion 402 to the rear portion 401. The front portion 402 includes a protrusion 406 having a plurality of adjustment holes 409. The rear portion 401 includes a channel member 411 having a hollow interior. The hollow interior is of a size to allow the protrusion 406 to easily slide into the channel member 411. A pin 446 passes through a hole 419 in the channel member 411. The protrusion 406 may be positioned so that the pin 446 passes through one of the adjustment holes 409, allowing the bracket 150 to be set to one of a plurality of predetermined lengths (the length of the bracket as used here is the dimension from the frontmost portion of the front leg 161 to the rearmost portion of the rear leg 158). The bracket 150 may therefore fit and accommodate gutters of various widths, including standard gutters.

Figure 5:
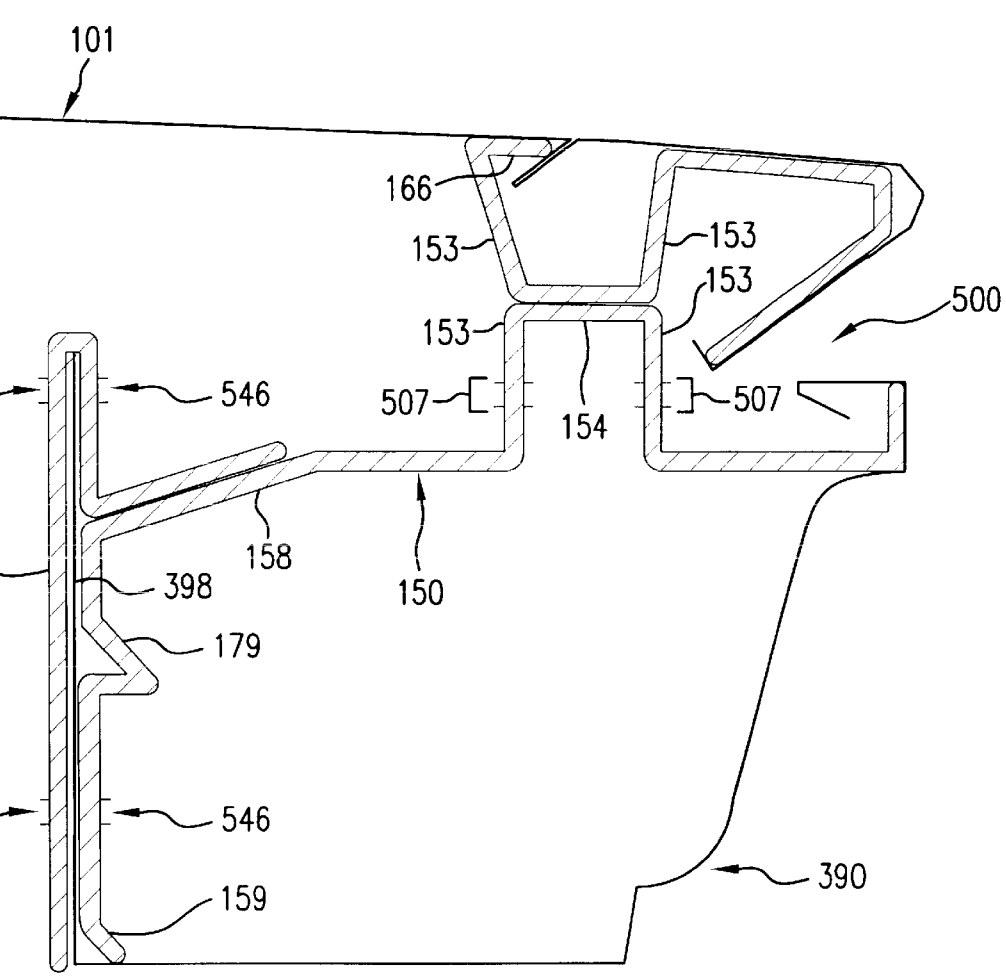
FIG. 5 shows a fifth embodiment similar to the second embodiment but additionally includes an anchor portion.

FIG. 5 shows a fifth embodiment 500 similar to the second embodiment shown in FIG. 2, but additionally includes an anchor portion 542 that extends substantially vertically from the rear leg 158, extends up and over the rear wall 398 of the gutter 390, and extends substantially vertically down behind the rear wall 398. Both the anchor portion 542 and the rear leg 158 may optionally include holes 546 that allow fasteners, such as nails, screws, etc., to affix the bracket 150 to a roof structure. The bracket 150 may also include optional holes 507 through the legs 153 for the purpose of providing access to fasteners employed on the rear leg 158 of the bracket 150.

Figure 6:
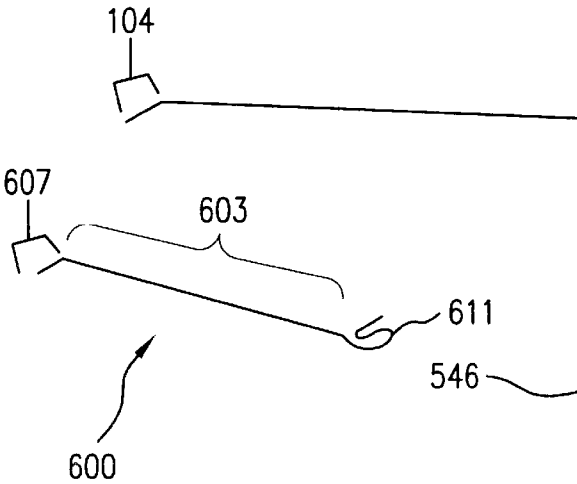
FIG. 6 shows an extension piece that may be connected to the roof seating lip of the cover in order to extend the reach of the cover.
Figure 7:
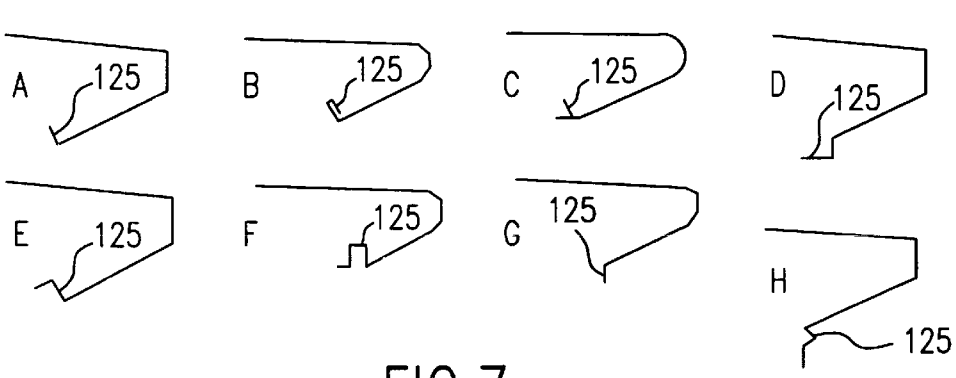
FIGS. 7A–7H show various embodiments of the bracket retention lip.
Figure 8:
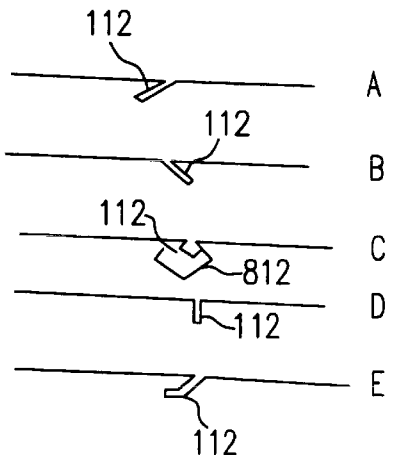
FIGS. 8A–8E show several different embodiments of the projection.

FIG. 6 shows an extension piece 600 that may be connected to the roof seating lip 104 of the cover 101 in order to extend the reach of the cover 101. This may be desirable in situations where the cover 101 needs to be inserted under a row of shingles, such as wooden or "shake" shingles. The extension piece 600 includes a span of material 603, a roof seating lip 607, and a retaining fold 611. The roof seating lip 104 of the cover 101 may be inserted into the retaining fold 611 in order to connect the two, and the retaining fold 611 may optionally be crimped to securely hold the extension piece 600 to the cover 101.

FIGS. 7A–7H show various embodiments of the bracket retention lip 125. The bracket retention lip 125 (see FIGS. 1–3 and 5) snaps over the end of the nose piece 172 of the bracket 150 in order to securely retain the cover 101 on the bracket 150. FIG. 7A shows a single substantially perpendicular vertical lip 125, while FIGS. 7B–7H show various hems, extra bends or varied angles, and combinations thereof. It should be understood that the shape, thickness, and angle of the lip 125 is not important, as long as the lip 125 engages the nose piece 172 of the bracket 150.

FIGS. 8A–8E show several different embodiments of the projection 112. Preferably, the projection 112 is formed of two layers of material, i.e., a double fold in the cover 101. FIG. 8A shows the backward angled double fold 112 as in the preferred embodiment. In FIG. 83, the double fold 112 is angled forward. In FIG. SC, the double fold 112 is substantially diamond-shaped having an open interior region. In FIG. 8D, the double fold 112 is substantially vertical. In FIG. 8E, the double fold 112 has an additional bend along its length. In addition to the above configurations, the present invention may include a reinforcing strip 812 having an interior cavity substantially matching the outer shape of the projection 112. In embodiments where the cover 101 is formed of a semi-rigid material, such as vinyl, for example, the reinforcing strip 812 may be snapped over the projection 112 to provide additional strength and rigidity.

FIGS. 9A–9D show several configurations of the roof seating lip 104. FIG. 9A is simply a bent portion of the cover 101. In FIG. 9B, there is a double bend in the roof seating lip, with a first portion angling down from the upper portion 107 of the cover 101, and a second portion angling back up to be substantially parallel to the upper portion 107. In FIG. 9C, the roof seating lip 104 includes a hem. In FIG. 9D, the roof seating lip 104 has an upward and then downward bend to form a ridge. This ridge may function to create a turbulent water flow and slow the flow.

FIGS. 10A–10C show a variety of configurations or profiles of the nose portion 116. In FIG. 10A, the nose portion 116 is formed of three planar portions, giving the nose portion 116 a vertical or squared-off front face. In FIG. 10B, the nose portion 116 is formed of more than three small planar sections to form an approximately rounded nose portion 116. In FIG. 10C, the nose portion 116 is substantially round.

Figure 11A:
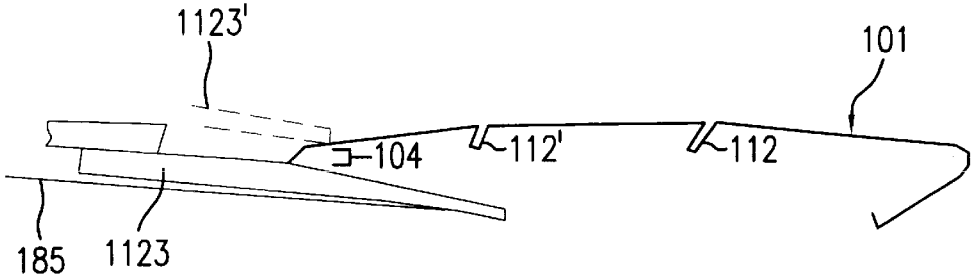
FIGS. 11A–11D show various embodiments of the cover, illustrating various schemes for sealing or engaging the roof seating lip to the roof.
Figure 11B:
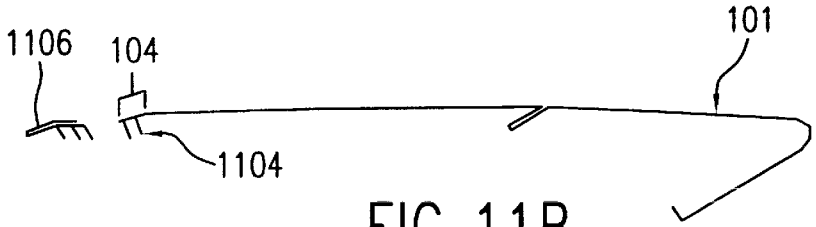
Figure 11C:
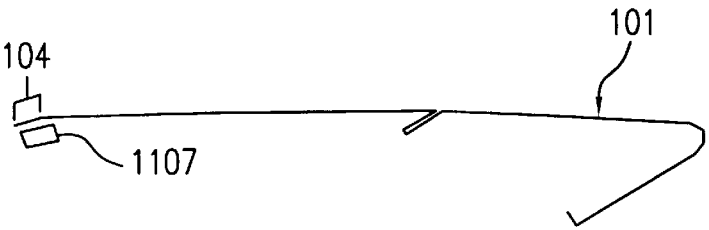

FIGS. 11A–11C show various embodiments of the cover 101, illustrating various schemes for sealing or engaging the roof seating lip 104 to the roof 185. FIG. 11A shows a cover 101 having two projections 112 and 112'. FIG. 11A also shows the placement of the roof seating lip 104 both on top of a row of shingles 1123 and alternatively under a row of shingles 1123'.

FIG. 11B shows perpendicular fins 1104 that seat against the roof 185. Alternatively, as shown, the fins 1104 may be formed on a separate piece 1106 that may be slipped onto or crimped onto the cover 101. The fins 1104 may be rigid, or may deform when pressed against the roof.

Figure 11D:
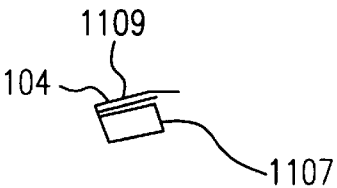

FIG. 11C shows the cover 101 including a strip of seating tape 1107. The detail of FIG. 11D shows how the roof seating tape 1107 may be seated on a double lip or hem 1109 of the roof seating lip 104.

Figure 12A:
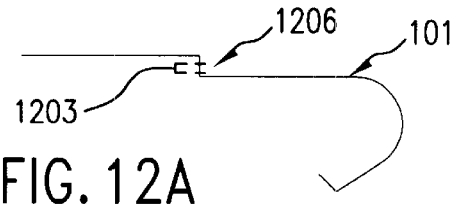
FIGS. 12A–12J show several different embodiments wherein other structures are substituted for the projection, including holes through which the cover retaining lip may project.
Figure 12B:
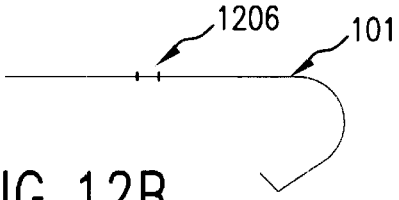
Figure 12C:
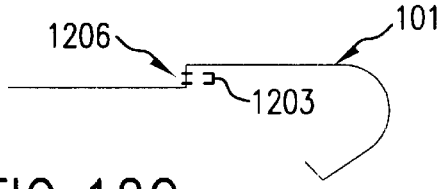
Figure 12D:
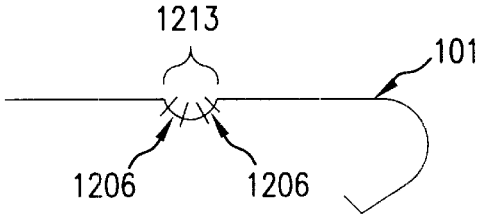
Figure 12E:
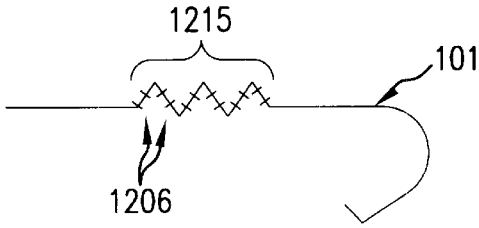
Figure 12F:
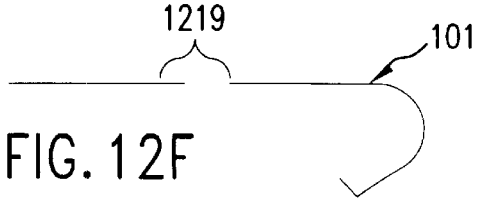
Figure 12G:
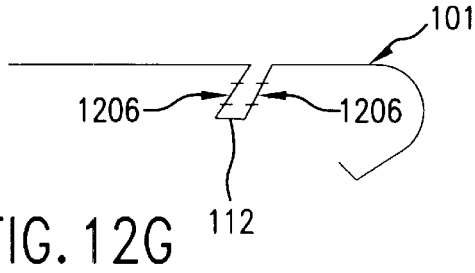
Figure 12H:
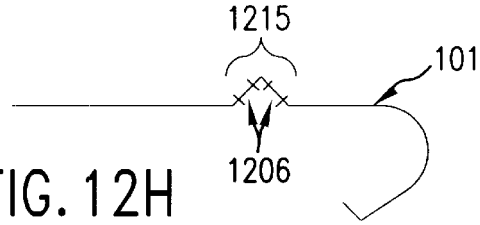
Figure 12I:
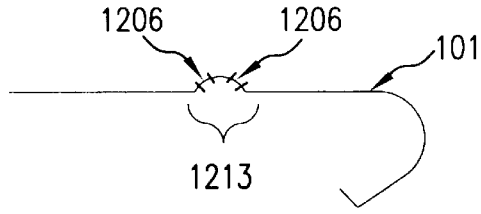
Figure 12J:
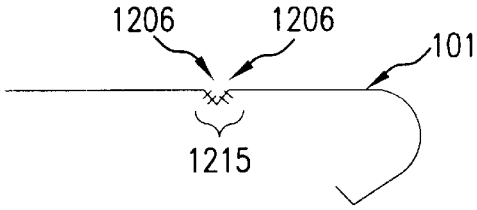

FIGS. 12A–12J show several different embodiments wherein other structures are substituted for the projection 112, including holes through which the cover retaining lip 166 may project. FIGS. 12A, 12C, and 12F include a vertical portion or face having a hole 1206 for the cover retaining lip 166. In FIG. 12B, the cover 101 includes a simple hole 1206. FIGS. 12D and 12I include a substantially semi-circular groove 1213 having one or more holes 1206. FIGS. 12E, 12H, and 12J include one or more peaks 1215 having holes 1206 through the sides thereof. Finally, FIG. 12G shows a fold type projection 112 having holes 1206 through both sides of the projector 112.

Figure 13A:
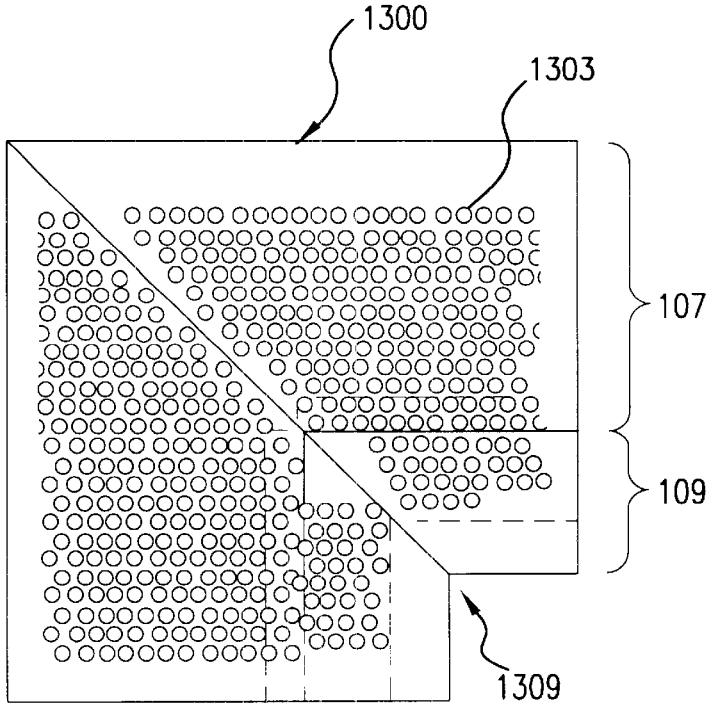
FIG. 13A shows a corner piece.

FIG. 13A shows a corner piece 1300 having a plurality of holes 1303 for drainage. The corner piece 1300 is essentially two sections of cover 101 formed at a right angle.

FIGS. 13B–13E show an end cap 1360 that may be placed in a gutter (such as the gutter 190 of FIG. 1, for example), to seal off the end of a gutter run. The purpose of the end cap 1360 is to keep birds, insects, leaves, twigs, etc., from entering the gutter 190 at the ends.

Figure 13B:
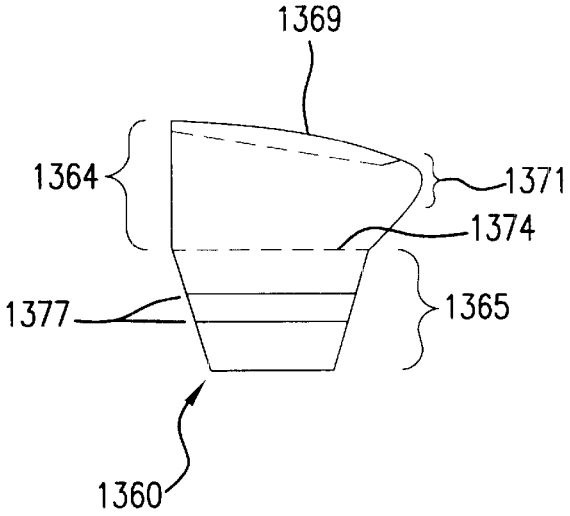
FIG. 13B–13E shows an end cap.
Figure 13C:
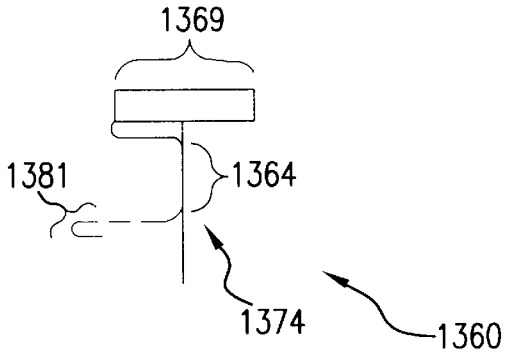

As can be seen from FIGS. 13B–13C, the end cap 1360 is essentially a piece of sheet material formed to have an upper mostly horizontal portion 1369, an upper vertical portion 1364 that extends between the gutter 190 and the cover 101, and a lower vertical portion 1365 that is designed to fit down and inside most gutters. The end cap 1360 also includes a bend line 1374 and a plurality of scoring lines 1377. The bend line 1374 is discussed below in conjunction with FIGS. 13D and 13E. The plurality of scoring lines 1377 allow bottom sections of the end cap 1360 to be broken off to fit gutters of different depths. The plurality of scoring lines may also be used to accommodate gutter offsets, discussed below in conjunction with FIG. 13E.

Although the lower vertical portion 1365 is depicted as being somewhat tapered (to aid insertion into a gutter), it should be understood that the edges may be vertical or may be vertical with sloping scoring lines (not shown) that allow edges of the lower vertical portion 1365 to be broken to fit a particular gutter.

Also shown in FIG. 13C is a hem 1381. When the lower vertical portion 1365 is bent up along the bend line 1374 as shown by the dashed lines, the hem 1381 may engage a horizontal flange that extends from the gutter end panel (see FIG. 13E).

Figure 13E:
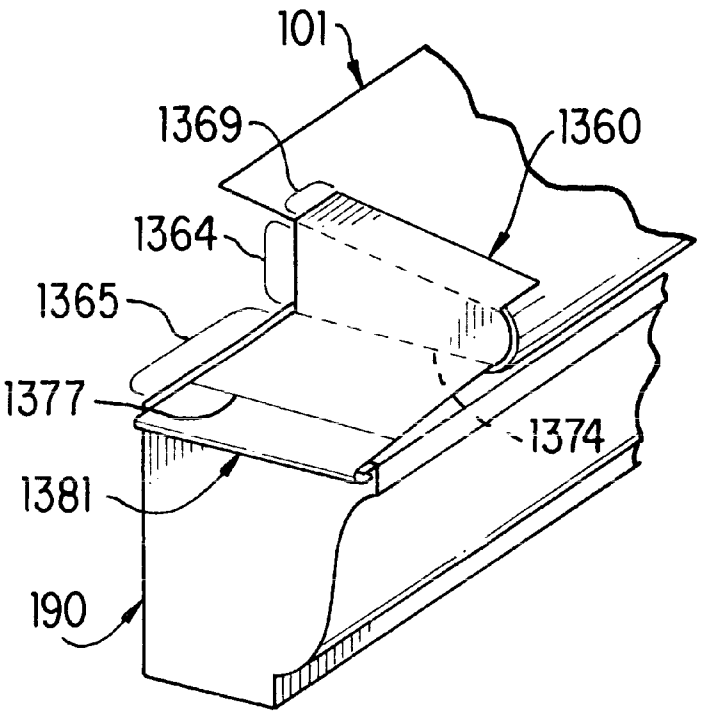
Figure 13D:
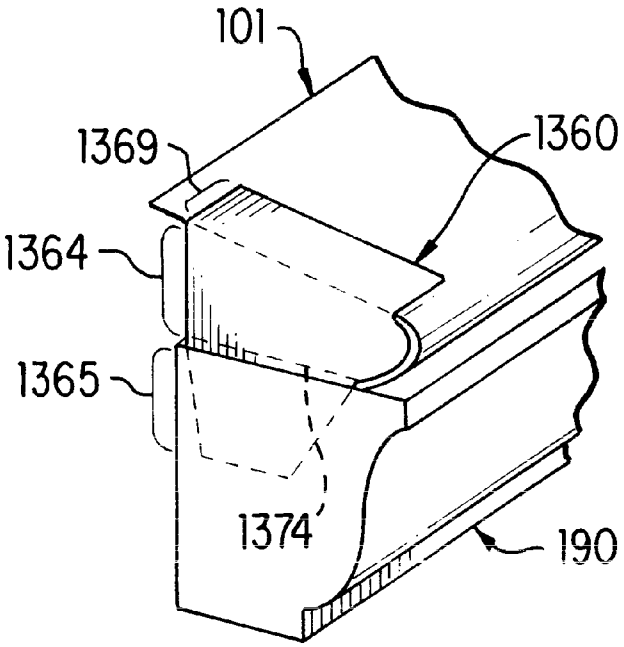

FIGS. 13D and 13E show the end cap 1360 in use. The upper mostly horizontal portion 1369 rests on top of the cover 101, with a nose profile 1371 (see FIG. 13B) fitting substantially into the nose portion of the cover 101. In gutters that end flush with a roof, and therefore flush with the cover 101, such as in FIG. 13D, the lower vertical portion 1365 remains vertical and is adjacent the end of the gutter 190.

In gutter installations where the gutter extends out beyond the roof and the cover 101, such as depicted in FIG. 13E, the end cap 1360 may be bent along the bend line 1374, with the lower vertical portion 1365 extending substantially horizontally along the top of the gutter 190. The scoring lines 1377 may be used to break off an excess portion of the lower vertical portion 1365, or alternatively it may be trimmed off by hand.

Figure 14:
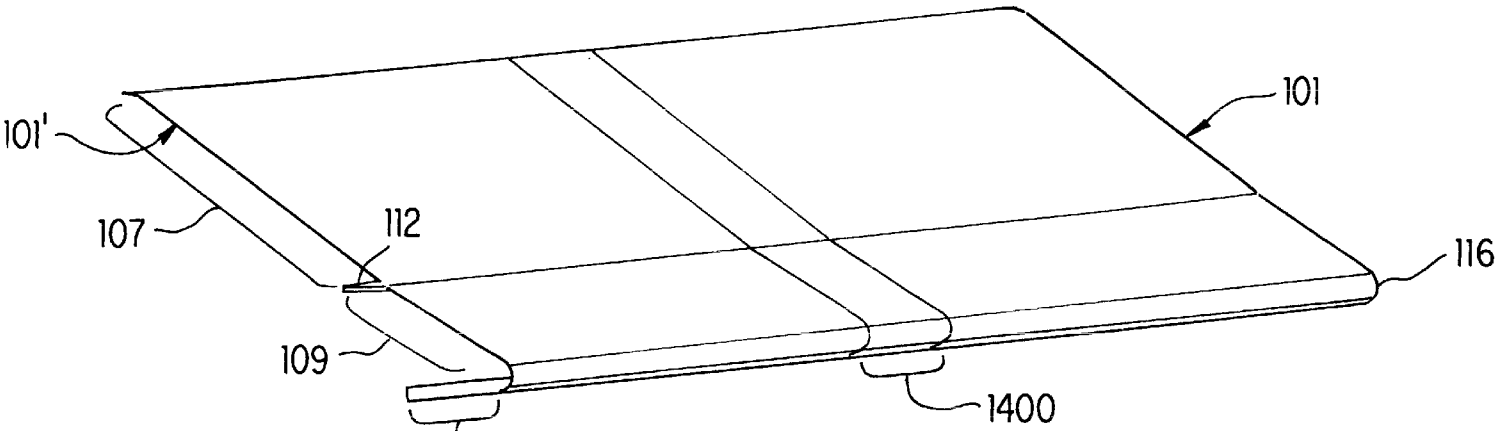
FIG. 14 shows how multiple sections of the cover may be fitted together.

FIG. 14 shows how multiple sections of the cover 101 may be fitted together and may overlap when in place. Essentially, a second cover 101' may be put in position and an end thereof may snap over and overlap a first cover 101' (see region 1400). The two covers do not need to slide together.

Figure 15:
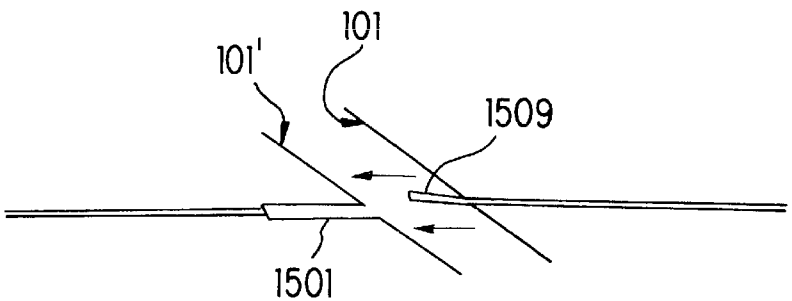
FIG. 15 shows additional detail wherein a first cover includes a tab that fits into a slot in a second cover.

FIG. 15 shows additional detail wherein a first cover 101 includes a tab 1509 that fits into a slot 1501 in the second cover 101'. The tab 1509 and slot 1501 may be used to align and guide the insertion and assembly of successive covers 101.

Figure 16A:
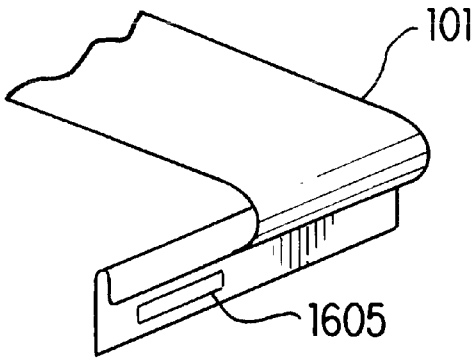

FIGS. 16A–16 show a slot 1605 that may be used during assembly or removal of the cover 101. A screwdriver or similar tool may be inserted into the slot 1605 in order to pull the return portion 122 of the cover 101 downward to disengage the cover 101 from a bracket 150. In this way, the cover 101 may be removed without damaging the gutter protection system.

Figure 17:
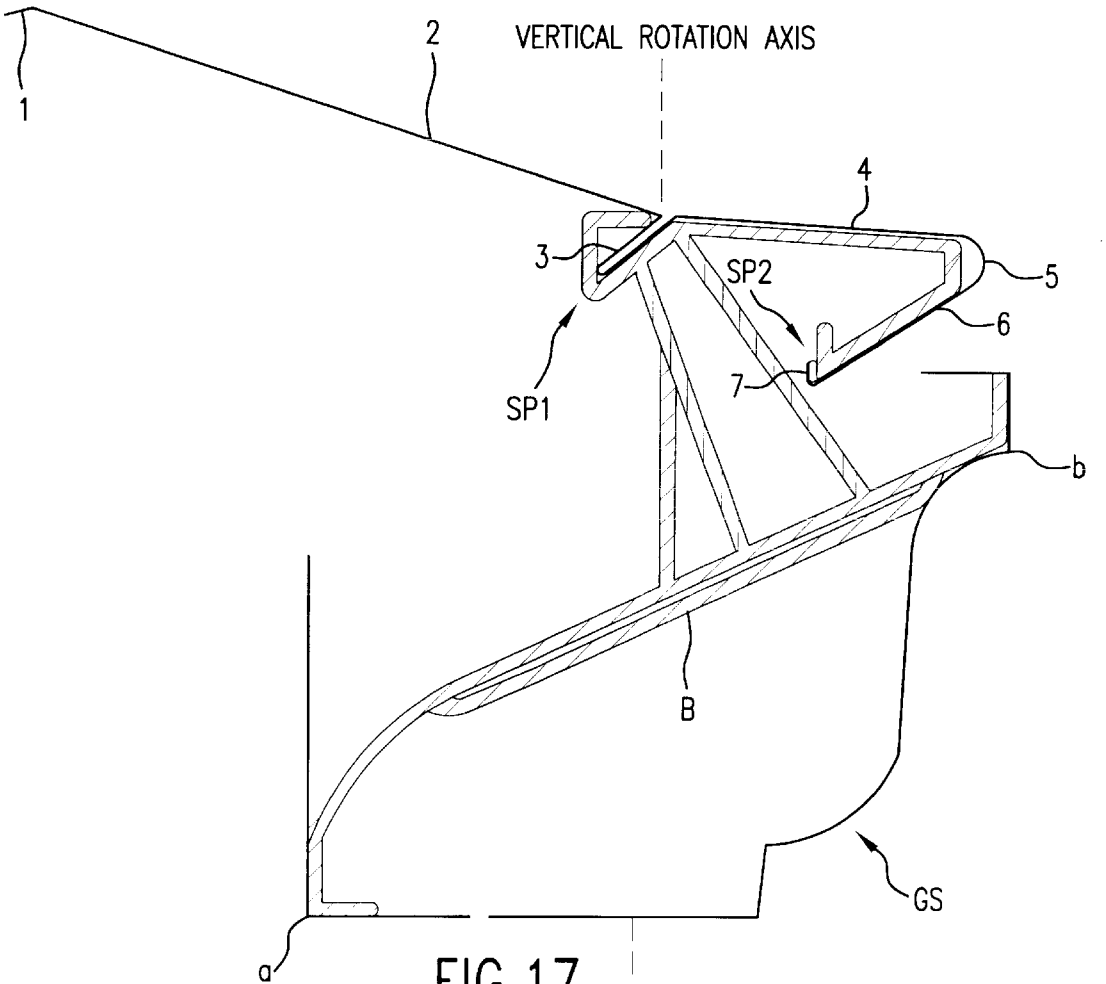
FIG. 17 shows a gutter system (GS) in left-side elevational cross-section.

The present invention assumes the presence of a gutter system at the lower edge of a sloped roof on an enclosed space, (e.g., a building, house, etc.). The accompanying FIG. 17 shows such a gutter system (GS) in left-side elevational cross-section, with a present invention mounting bracket B present there within, and with a gutter protection system present at the top thereof.

The gutter system, shown as viewed in left side elevation can be seen to comprise a vertical back at the left side, (which vertical back is typically affixed to a wall of a building which has a sloped roof). A horizontal bottom merges from the vertical back via a bottom ninety (90) degree angle, (see "a"), and the horizontal bottom projects to where, at a right side of the horizontal bottom, various lengths of gutter material project via straight lengths and curved lengths etc., to the point where an upper right side ninety (90) degree bend (see "b"), is formed, which upper right side ninety (90) degree bend (see "b"), is horizontally offset from the vertical back and vertical offset from the horizontal bottom.

Note that the mounting bracket B has a portion thereof which snugly fits within the confines of the gutter system at lower aspects thereof, between the ninety degree bend points labeled "a" and "b". That is, the mounting bracket is of a shape such that it can be easily positioned in a gutter system, (when it is rotated ninety (90) degrees to that shown in FIG. 17 around an essentially centrally positioned vertical axis, (see VERTICAL ROTATION AXIS in FIG. 17), of the mounting bracket so as to project the side shown in FIG. 17 into the paper), and then rotated into the position shown in FIG. 17. Note that the mounting bracket has a depth into the page of FIG. 17 of about an inch or so and therefore becomes very well secured in the gutter system between the ninety (90) degree bend points "a" and "b" over the depth, by the described action.

Continuing, in practice of the method of the present invention a number of mounting brackets B will be positioned in a length of gutter, with a functional distance between adjacent mounting brackets. The functional distance is determined by available lengths of gutter protection system. With a functional number of mounting brackets B in place, it would be easy to appreciated from FIG. 17 that a length of gutter protection system can be easily snapped into the upper portions of at least two of the mounting brackets B with securement at snap-point 1 (SP1) and snap-point 2 (SP2).

Figure 10:
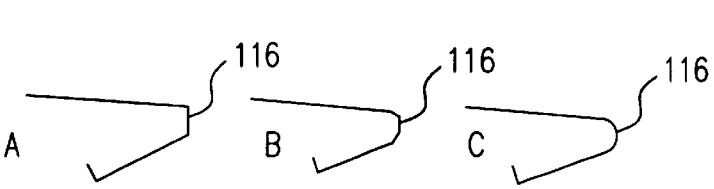
FIGS. 10A–10C show a variety of configurations or profiles of the nose portion.
Figure 9:
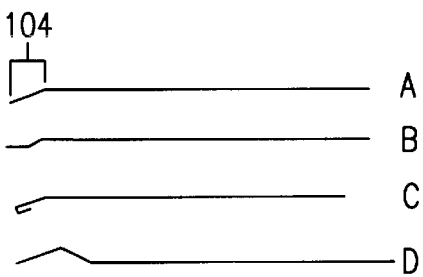
FIGS. 9A–9D show several configurations of the roof seating lip.

Note that the gutter protection system, as shown in left-side-elevation-cross-section in FIG. 17 begins at the far left side thereof with an optional upward and to the right projecting length of construction material (1), which optional upward and to the right projecting length of construction material (1), which merges into a first downward and to the right projecting length of construction material (2). At some distance along the first downward and to the right projecting length of construction material (2) a series of three bends provides a lip (3) which is seen to fit into the mounting bracket snap-point 1 when optional the upward and to the right projecting length of construction material (1) makes contact with the sloping roof of the building to which the gutter system is affixed. The lip forming series of three bends provide for a length of construction material which projects downward and to the left, merging from the first downward and to the right projecting length of construction material (2). The downward and to the left projecting length of construction material merges into an upward and to the right projecting length of construction material, which in turn merges into a length of construction material (4) which projects downward and to the right at about a fifteen (15%) percent grade as set by contact with the underlying portion of the mounting bracket B. The length of construction material (4) which projects downward and to the right at a fifteen (15%) percent grade then is seen to merge into, preferably, a gradual, to the left opening, bending length of construction material (5), and the gradual, to the left opening, gradual bending length of construction material (5) is shown to merge into a following downward and to the left projecting length of construction material (6), which merges into a short upward projecting length of construction material (7). Note that FIG. 10 shows a variety of acceptable embodiments of the length of construction material identified by identifier (5). Note also that the short upward projecting length of construction material (7) contacts the mounting bracket B at snap-point 2 when the lip region (3) of the gutter protection system mates with the portion of the mounting bracket B identified as snap-point 1. As alluded to, this arrangement forces the length of construction material (4) to project downward and to the right at about a fifteen (15%) percent grade, which is considered an optimum grade.

It should be appreciated that the far left end of the gutter protection system, (e.g. The leftmost end of the first downward and to the right projecting length of construction material (2), and/or the optional upward and to the right projecting length of construction material (1)) can be placed atop or under a first row of shingles on the sloped roof.

It should be understood that the design of the mounting bracket B can be varied as long as the functional aspects thereof remain intact—that is as long as it mediates connection between an underlying gutter system and a gutter protection system as shown, via snap-points. The important things about the mounting bracket B being that it generally fits "snugly" in the gutter system, and that it provides snap-points whereat the gutter protection system mounts in use, via mating between aspects of the gutter protection system and the mounting bracket snap-points. The embodiment of the present invention mounting bracket B shown in FIG. 17 demonstrates that a functional mounting bracket B provides regions for securing in a gutter system by contact inside the gutter system at contact points "a" and "b".

Present atop the regions for securing in a gutter system by contact inside the gutter system at contact points "a" and "b", is means for securing the snap-points in place so that when a gutter protection system is secured to the mounting bracket B, the length of construction material (4) is forced into a downward and to the right at about a fifteen (15%) percent grade, which is considered an optimum grade. Any functional mounting bracket B for providing the relative positioning and securing of the mounting bracket B in a gutter system and of the gutter protection system thereto is within the scope of the present invention. That is, the function the mounting bracket B performs in mediating mounting of a gutter protection system atop a gutter system via a rotational motion of the mounting bracket B in a gutter system, and the affixing of a gutter protection system thereto by a pushing motion, constitutes the critical focus of the present invention, rather than the specific design of various aspects of the mounting bracket B.

It is noted that the mounting bracket B is preferable made of a material which has a "memory", (e.g. vinyl), to aid with establishing a good fit of the mounting bracket in a gutter system. See the "flex area" in FIG. 1. However, any functional material can be utilized to construct the mounting bracket, and where a gutter system is of a constant size and the mounting bracket fits snugly therewithin, the "memory" effect becomes unnecessary thereby allowing the mounting bracket to be made from rigid material.

Particularly relevant to the method of use of the present invention which allows mounting the gutter protection system to the mounting bracket B, is that the angle at which the lip (3) projects downward and to the left, is essentially equivalent to the angle at which the following downward and to the left projecting length of construction material (6) projects downward and to the left. This enables mounting of the gutter protection system to the mounting bracket at the "snap-points" by a simple "position and push" motion.

While the invention has been described in detail above, the invention is not intended to be limited to the specific embodiments as described. It is evident that those skilled in the art may now make numerous uses and modifications of and departures from the specific embodiments described herein without departing from the inventive concepts.

What is claimed is:

1. A gutter protection system adapted to be used with a gutter having a length, front and rear walls, a gutter front lip extending backward from said front wall into said gutter, and a bottom surface, comprising:

a gutter cover having a length and having an upper portion adapted to be positioned over a roof and a lower portion adapted to be positioned over said gutter, with said lower portion having a nose portion, said nose portion including a return portion that is bent downward and backward substantially toward a center region of said gutter to guide a water stream into said gutter, and at least one projection positioned between said lower and upper portions; and a bracket adapted to hold said gutter cover in relation to said gutter, said bracket having a lower portion adapted to engage said gutter and an upper portion adapted to extend above said gutter and engaging said lower portion of said gutter cover, said lower portion of said bracket having a rear leg having a substantially vertical portion adapted to be positioned against said rear wall of said gutter and a front leg adapted to be positioned within said front lip of said gutter, said upper portion of said bracket having a nose piece fitting inside said nose portion of said gutter cover, and said bracket having a cover retaining lip on a rear region of said upper portion, said cover retaining lip engages said at least one projection of said gutter cover;

wherein said bracket is adapted to hold said gutter cover in position in relation to said gutter such that said upper portion of said gutter cover is adapted to be positioned over a roof and said lower portion of said gutter cover is adapted to be positioned over said gutter at a predetermined angle, and wherein said at least one projection of said gutter cover engages said cover retaining lip of said bracket while said nose portion of said gutter cover fits over said nose piece of said bracket so that said gutter cover is held at two points on said bracket.

2. The gutter protection system of claim 1, wherein said upper portion of said gutter cover is adapted to flex to accommodate a roof pitch.

3. The gutter protection system of claim 1, further including a clip on said substantially vertical portion of said rear leg of said bracket, with said clip capable of engaging a rear wall top lip formed on a top edge of a rear wall of said gutter, said rear wall top lip extending downward and inward toward a center region of said gutter, and with said clip supporting said gutter.

4. The gutter protection system of claim 1, wherein said bracket is adapted to hold said gutter cover against said roof under tension.

5. The gutter protection system of claim 1, wherein said predetermined angle at which said bracket holds said lower portion of said gutter cover is about three degrees to about twenty degrees from a roof horizontal orientation.

6. The gutter protection system of claim 1, wherein said predetermined angle at which said bracket holds said lower portion of said gutter cover is about fifteen degrees from a roof horizontal orientation.

7. The gutter protection system of claim 1, wherein said bracket is adapted to twist and snap into said gutter and said gutter cover snaps onto said bracket.

8. The gutter protection system of claim 1, wherein said gutter protection system is formed of metal.

9. The gutter protection system of claim 1, wherein said gutter protection system is formed of plastic.

10. The gutter protection system of claim 1, wherein said gutter protection system is formed of fiberglass.

11. The gutter protection system of claim 1, wherein said gutter protection system is formed of vinyl.

12. The gutter protection system of claim 11 wherein said gutter cover further includes at least one predetermined scoring line on said upper portion to allow said gutter cover to be broken to a desired size.

13. The gutter protection system of claim 1, wherein said gutter cover has at least one through retaining hole for receiving said bracket retaining lip of said bracket in order to retain said gutter cover in relation to said bracket.

14. The gutter protection system of claim 1, wherein said at least one projection is at an angle to said gutter cover.

15. The gutter protection system of claim 1, wherein an end dimension of said at least one projection is wider than a dimension of a base of said at least one projection.

16. The gutter protection system of claim 1, wherein said at least one projection has at least one through retaining hole for receiving said bracket retaining lip of said bracket in order to retain said gutter cover in relation to said bracket.

17. The gutter protection system of claim 1, wherein said at least one projection further includes a snap-on reinforcement piece having an inner volume shaped substantially identical to said at least one projection.

18. The gutter protection system of claim 1, wherein said at least one projection comprises a flex fold formed of two surfaces in spaced apart relation.

19. The gutter protection system of claim 1, wherein a said at least one projection includes a bend between a base of said at least one projection and an end of said at least one projection.

20. The gutter protection system of claim 1, wherein said at least one projection comprises a substantially semi-circular groove.

21. The gutter protection system of claim 1, wherein said at least one projection comprises a step.

22. The gutter protection system of claim 1, wherein a profile of said nose portion of said gutter cover comprises a substantially rounded profile.

23. The gutter protection system of claim 1, wherein a profile of said nose portion of said gutter cover comprises a plurality of substantially planar surface portions.

24. The gutter protection system of claim 1, wherein said nose portion of said gutter cover is adapted to be substantially flush with said front wall of said gutter.

25. The gutter protection system of claim 1, wherein said nose portion of said gutter cover is adapted to be recessed from said front wall of said gutter.

26. The gutter protection system of claim 1, wherein said nose portion of said gutter cover further includes a bracket retention lip extending in a substantial vertical manner to said return portion.

27. The gutter protection system of claim 1, wherein said nose portion of said gutter cover further includes a bracket retention lip extending in a substantially perpendicular manner to said return portion.

28. The gutter protection system of claim 1, wherein said upper portion of said gutter cover further includes a roof seating lip, with said roof seating lip being angled from said upper portion of said gutter cover and being canted at an angle downwards toward said roof and being adapted to contact said roof.

29. The gutter protection system of claim 1, wherein said roof seating lip further includes a bend, with an outer roof seating lip portion being substantially parallel to said upper portion of said gutter cover, with said bend forming a trough on a topside of said roof seating lip.

30. The gutter protection system of claim 1, wherein said roof seating lip further includes a bend, with an inner roof seating lip portion adapted to extend upward away from said roof and an outer roof seating lip portion adapted to extend downward toward said roof, with said bend forming a trough on a topside of said roof seating lip.

31. The gutter protection system of claim 1, wherein said roof seating lip further includes a sealing strip attached to said roof seating lip.

32. The gutter protection system of claim 1, wherein said front leg of said bracket further includes a substantially vertical portion extending upwards from said front leg.

33. The gutter protection system of claim 1, wherein said rear leg of said bracket further includes a substantially horizontal portion extending inwardly from said rear leg.

34. The gutter protection system of claim 1, wherein said rear leg of said bracket further includes a curved flex area to accommodate a gutter size.

35. The gutter protection system of claim 1, wherein said rear leg of said bracket further includes at least one predetermined scoring line to allow said rear leg to be broken to a desired size.

36. The gutter protection system of claim 1, wherein said retaining lip of said bracket is an edge of a cavity, with said at least one projection of said gutter cover extending into said cavity.

37. The gutter protection system of claim 1, wherein said bracket further includes at least one hole for a fastener in said substantially vertical portion of said rear leg.

38. The gutter protection system of claim 1, wherein said bracket is comprised of a front portion and a rear portion, and wherein said front portion is capable of being removably affixed to said rear portion to form a bracket having a plurality of predetermined lengths.

39. The gutter protection system of claim 1, wherein said system further includes an end cap comprising:

an upper mostly horizontal portion designed to rest on top of said cover; and a substantially vertical side panel including an upper vertical portion that is adapted to extend between said gutter and said cover and a lower vertical portion that is adapted to fit down and inside said gutter, with said upper and lower vertical portions being separated by a bend line.

40. The gutter protection system of claim 1, wherein said system further includes an end cap comprising:

an upper mostly horizontal portion designed to rest on top of said cover; and a substantially vertical side panel including an upper vertical portion that is adapted to extend between said gutter and said cover and a lower vertical portion that is adapted to fit down and inside said gutter, with said upper and lower vertical portions being separated by a bend line, and said lower vertical portion further including at least one scoring line that allows a portion of said lower vertical portion to be broken off to accommodate various gutter types.

41. The gutter protection system of claim 1, wherein said bracket further comprises:

a front portion including a protrusion, said protrusion including a plurality of adjustment holes;

a rear portion including a channel member adapted to allow said protrusion of said front portion to slide into said channel member and having a hole passing through said channel member; and a pin;

wherein when said bracket is assembled said protrusion of said front portion is slid into said channel member of said rear portion and said pin is inserted through said hole of said channel member and also through one of said plurality of adjustment holes to set a length of said bracket.

42. A method of installing a bracket of said gutter protection system of claim 1, comprising the steps of:

positioning a bracket in a gutter in a placement wherein said bracket is not substantially transverse to said gutter, and a lowermost portion of said bracket is in contact with a bottom surface of said gutter; and rotating said bracket until said bracket is substantially transverse to said gutter and a frontmost portion of said bracket is in contact with a front wall of said gutter.

43. The method of claim 42, wherein said bracket has a substantially central axis of rotation.

44. The method of claim 42, wherein said gutter exerts a compression force on said bracket when said bracket is in position in said gutter.

45. The method of claim 42, wherein a plurality of brackets are inserted into said gutter according to said positioning and rotating steps.

46. The method of claim 42, wherein said bracket is removably retained in said gutter.

47. The method of claim 42, wherein a rear leg of said bracket is affixed to a structure external to said gutter.

48. A method of installing a bracket and a gutter cover of said gutter protection system of claim 1, comprising the steps of:

positioning a bracket in a gutter in a placement wherein said bracket is not substantially transverse to said gutter, and a lowermost portion of said bracket is in contact with a bottom surface of said gutter;

rotating said bracket until said bracket is substantially transverse to said gutter and a frontmost portion of said bracket is in contact with a front wall of said gutter;

placing a nose portion of said gutter cover over a nose piece of said bracket; and inserting a projection of said gutter cover into a cover retaining lip of said bracket.

49. The method of claim 48, wherein said bracket has a substantially central axis of rotation.

50. The method of claim 48, wherein said gutter exerts a compression force on said bracket when said bracket is in position in said gutter.

51. The method of claim 48, wherein a plurality of brackets are inserted into said gutter according to said positioning and rotating steps.

52. The method of claim 48, wherein said bracket is removably retained in said gutter.

53. The method of claim 48, wherein a rear leg of said bracket is affixed to a structure external to said gutter.

54. The method of claim 48, wherein said nose portion of said gutter cover snaps over said nose piece of said bracket.

55. The method of claim 48, wherein said nose portion of said gutter cover is held in place on said nose piece of said bracket by a bracket retention lip extending from said nose portion at an angle and engaging an end of said nose piece of said bracket.

56. The method of claim 48, wherein said gutter cover is removably retained on said bracket.

57. The method of claim 48, wherein said projection is a flex fold.

58. The method of claim 48, wherein said projection snaps into said cover retaining lip.

59. The method of claim 48, wherein a plurality of brackets are inserted into said gutter according to said positioning and rotating steps and said gutter cover is placed on said plurality of brackets.

60. A gutter protection system, comprising:

a gutter having a length, front and rear walls, a gutter front lip extending backward from said front wall into said gutter, and a bottom surface, with said rear wall including a rear wall top lip and said front wall including a front wall top lip;

a gutter cover having a length and having an upper portion adapted to be positioned over a roof and a lower portion for being positioned over said gutter, with said lower portion having a nose portion, said nose portion including a return portion that is bent downward and backward substantially toward a center region of said gutter to guide a water stream into said gutter, and at least one projection positioned between said lower and upper portions; and a bracket for holding said gutter cover in relation to said gutter, said bracket having a lower portion engaging said gutter and an upper portion extending above said gutter and engaging said lower portion of said gutter cover, said lower portion of said bracket having a rear leg having a substantially vertical portion adapted to be positioned against said rear wall of said gutter and including a clip having a throat leading to a wider portion, said lower portion further having a front leg positioned within said front lip of said gutter, said upper portion of said bracket having a nose piece fitting inside, said nose portion of said gutter cover, and said bracket having a cover retaining lip on a rear region of said upper portion, said cover retaining lip engages said at least one projection of said gutter cover;

wherein said bracket holds said gutter cover in position in relation to said gutter such that said upper portion of said gutter cover is adapted to be positioned over a roof and said lower portion of said gutter cover is positioned over said gutter at a predetermined angle, and wherein said at least one projection of said gutter cover engages said cover retaining lip of said bracket while said nose portion of said gutter cover fits over said nose piece of said bracket so that said gutter cover is held at two points on said bracket.

61. A method of installing a gutter and a bracket of said gutter protection system of claim 60, comprising the steps of:

affixing a rear leg of said bracket to a roof structure, said rear leg including a clip;

moving a rear wall of said gutter up into said clip of said bracket, said rear wall including a rear wall top lip that snaps into and is removably retained by said clip; and moving a front wall of said gutter up and over a front leg of said bracket, said front wall including a front wall top lip that snaps over and is removably retained by said front leg.

62. The method of claim 61, further including the steps of:

placing a nose portion of a gutter cover over a nose piece of said bracket; and inserting a projection of said gutter cover into a cover retaining lip of said bracket.

63. The method of claim 61, wherein said gutter cover is removably retained on said bracket.

64. The method of claim 61, wherein a plurality of brackets are affixed to said roof structure to support said gutter and said gutter cover is placed on said plurality of brackets.

65. The method of claim 61, wherein a gap exists between said roof structure and an upper portion of said rear leg so that said bracket can flex to accommodate loose and tight gutters.

66. The method of claim 61, wherein said clip is a separate piece, and said clip in conjunction with said front leg of said bracket support said gutter.

67. The method of claim 61, wherein said clip is a separate piece and said clip in conjunction with said front leg of said bracket support said gutter, and said rear leg of said bracket further includes a foot that snaps into and is removably retained by said clip.

68. The method of claim 61, wherein said gutter exerts a compression force on said bracket when said bracket is in position in said gutter.

69. The method of claim 61, wherein said dose portion of said gutter cover snaps over said nose piece of said bracket.

70. The method of claim 61, wherein said nose portion of said gutter cover is removably retained on said nose piece of said bracket by a bracket retention lip extending from said nose portion at an angle and engaging an end of said nose piece of said bracket.

71. The method of claim 61, wherein said projection is a flex fold.

72. The method of claim 61, wherein said projection snaps into said cover retaining lip.

73. A gutter protection system comprising, as viewed in left side elevation, and adapted to be mounted to a sloped roof building and beginning at the left side thereof:

a first downward and to the right projecting length of construction material (2), which first downward and to the right projecting length of construction material (2) merges into a lip, said lip providing a first length of construction material which projects downward and to the left, and a second length of construction material which projects upward and to the right substantially parallel to said first length of construction material of said lip, at the position of its merging from said first downward and to the right projecting length of construction material (2) being functionally merged into a length of construction material (4) which projects downward and to the right at a nominal fifteen (15%) percent grade, said length of construction material (4) which projects downward and to the right at a nominal fifteen (15%) grade being merged into a following downward and to the left projecting length of construction material (6), which merges into a short upward length of construction material (7).

74. A gutter protection system as in claim 73 which further comprises an upward and to the right projecting length of construction material (1) at the left side thereof, which is merged into said first downward and to the right projecting length of construction material (2).

75. A gutter protection system as in claim 73 wherein said length of construction material (4) which projects downward and to the right at a nominal fifteen (15%) percent grade is merged into said following downward and to the left projecting length of construction material (6), by an intervening length of construction material (5) which is of a shape selected from the group consisting of: at least one curved length of construction material, at least one straight length of construction material and a combination of at least one curved length of construction material and at least one straight length on construction material.

76. A gutter protection system as in claim 73, wherein said lip is formed by merging from said first downward and to the right projecting length of construction material (2) into a downward and to the left projecting length of construction material which is merging into an upward and to the right projecting length of construction material which merges into said length of construction material (4) which projects downward and to the right at a nominal fifteen (15%) percent grade.

77. A gutter protection system as in claim 73, which further comprises at least on mounting bracket, said mounting bracket comprising at least two "snap-points", which "snap-points" mate with the lip and short upward projecting length of construction material (7) respectively in use, and forces said length of construction material (4) to project downward and to the right at a nominal fifteen (15%) percent grade.

78. A gutter protection system as in claim 73, in which said at least one mounting bracket is of a shape and size to snugly fit within an underlying gutter system, which gutter system, as viewed in left side elevation, comprises an essentially vertical back at the left side, which essentially vertical back is typically affixed to a wall of a building which has a sloped roof, said gutter system further comprising an essentially horizontal bottom which merges from said essentially vertical back via a bottom ninety (90) degree bend, and said essentially horizontal bottom projecting to where, at a right side of the essentially horizontal bottom, one or more straight or curved lengths of gutter material project to a point where an upper right side ninety (90) degree bend is formed, which upper right side ninety (90) degree bend is horizontally offset from the essentially vertical back and vertical offset from the essentially horizontal bottom.

79. A gutter protection system as in claim 73, in which said mounting bracket is, in use, secured by contact with both said bottom ninety (90) degree bend and said upper right side ninety (90) degree bend of said gutter system.

80. A gutter protection system as in claim 73 wherein a gap between the following downward and to the left projecting length of construction material (6) of the gutter protection system, and the nearest aspect of said upper right side ninety (90) degree bend of said gutter system is three-eights (⅜) inch or less.

81. A gutter protection system comprising, as viewed in left side elevation, and adapted to be mounted to a sloped roof building and beginning at the left side thereof:

an upward and to the right projecting length of construction material (1) at the left side thereof, which is merged into said first downward and to the right projecting length of construction material (2), said first downward and to the right projecting length of construction material (2) being merged into a lip, said lip providing a length of construction material which projects downward and to the left, said lip at the position of its merging from said first downward and to the right projecting length of construction material (2) being functionally merged into a length of construction material (4) which projects downward and to the right at a nominal fifteen (15%) percent grade, said length of construction material (4) which projects downward and to the right at a nominal fifteen (15%) percent grade being merged into a into a following downward and to the left projecting length of construction material (6), which merges into a short upward projecting length of construction material(7);

wherein said lip is formed by merging from said first downward and to the right projecting length of construction material (2) into a downward and to the left projecting length of construction material which is merging into an upward and to the right projecting length of construction material which merges into said length of construction material (4) which projects downward and to the right at a nominal fifteen (15%) percent grade;

wherein said length of construction material (4) which projects downward and to the right at a nominal fifteen (15%) percent grade is merged into said following downward and to the left projecting length of construction material (6) by an intervening length of construction material (5) which is of a shape selected from the group consisting of: at least one curved length of construction material, at least one straight length of construction material and a combination of at least one curved length of construction material and at least one straight length of construction material;

wherein, in use, said gutter protection system is mounted to an underlying gutter system, which as viewed in left side elevation, comprises a vertical back at the left side, which an essentially vertical back is adapted to be affixed to a wall of a building which has a sloped roof, said gutter system further comprising an essentially horizontal bottom which merges from said essentially vertical back via a bottom ninety (90) degree bend, and said essentially horizontal bottom projecting to where, at a right side of the essentially horizontal bottom, one or more straight or curved lengths of gutter material project to a point where an upper right side ninety (90) degree bend is horizontally offset from the essentially vertical back and vertical offset from the essentially horizontal bottom;

said gutter protection system being mounted to said gutter system by way of at least one mounting bracket, said at least one mounting bracket being comprised of at least two "snap-points", which "snap-points" mate with the lip and short upward projecting length of construction material (7) respectively in use, and force said length of construction material (4) to project downward and to the right at a nominal fifteen (15%) percent grade;

said mounting bracket, in use, being secured by contact with both said bottom ninety (90) degree bend and said upper right side ninety (90) degree bend of said gutter system, such that a gap between the following downward and to the left projecting length of construction material (6) of the gutter projection system, and the nearest aspect of said upper right side ninety (90) degree bend of said gutter system is one-half (½) inch or less.

* * * * *